US008877413B2

(12) United States Patent
Yu

(10) Patent No.: US 8,877,413 B2
(45) **Date of Patent: *Nov. 4, 2014**

(54) FLEXIBLE IMAGING MEMBERS COMPRISING IMPROVED GROUND STRIP

(75) Inventor: Robert C. U. Yu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 162 days.

This patent is subject to a terminal disclaimer.

(21) Appl. No.: 13/216,151

(22) Filed: Aug. 23, 2011

(65) Prior Publication Data

US 2013/0052576 A1 Feb. 28, 2013

(51) Int. Cl.
*G03G 5/147* (2006.01)

(52) U.S. Cl.
USPC ..... 430/66; 430/58.05; 430/56

(58) Field of Classification Search
USPC ..... 430/56, 57, 58.05, 66
See application file for complete search history.

(56) References Cited

U.S. PATENT DOCUMENTS

| | | | | |
|---|---|---|---|---|
| 3,121,006 | A | | 2/1964 | Middleton et al. |
| 3,820,989 | A | | 6/1974 | Rule et al. |
| 3,837,851 | A | | 9/1974 | Shattuck et al. |
| 3,895,944 | A | | 7/1975 | Wiedemann et al. |
| 4,150,987 | A | | 4/1979 | Anderson et al. |
| 4,233,384 | A | | 11/1980 | Turner et al. |
| 4,245,021 | A | | 1/1981 | Kazami et al. |
| 4,256,821 | A | | 3/1981 | Enomoto et al. |
| 4,265,990 | A | | 5/1981 | Stolka et al. |
| 4,278,746 | A | | 7/1981 | Goto et al. |
| 4,286,033 | A | | 8/1981 | Neyhart et al. |
| 4,291,110 | A | | 9/1981 | Lee |
| 4,297,426 | A | | 10/1981 | Sakai et al. |
| 4,299,897 | A | | 11/1981 | Stolka et al. |
| 4,306,008 | A | | 12/1981 | Pai et al. |
| 4,315,982 | A | | 2/1982 | Ishikawa et al. |
| 4,338,387 | A | | 7/1982 | Hewitt |
| 4,338,388 | A | | 7/1982 | Sakai et al. |
| 4,385,106 | A | | 5/1983 | Sakai |
| 4,387,147 | A | | 6/1983 | Sakai |
| 4,399,207 | A | | 8/1983 | Sakai et al. |
| 4,399,208 | A | | 8/1983 | Takasu et al. |
| 4,439,507 | A | | 3/1984 | Pan et al. |
| 4,587,189 | A | | 5/1986 | Hor et al. |
| 4,664,995 | A | * | 5/1987 | Horgan et al. ..... 430/58.65 |
| 4,988,597 | A | | 1/1991 | Spiewak et al. |
| 5,215,839 | A | | 6/1993 | Yu |
| 5,244,762 | A | | 9/1993 | Spiewak et al. |
| 5,660,961 | A | | 8/1997 | Yu |
| 5,756,245 | A | | 5/1998 | Esteghamatian et al. |
| 5,958,638 | A | | 9/1999 | Katayama et al. |
| 6,124,514 | A | | 9/2000 | Emmrich et al. |
| 6,183,921 | B1 | | 2/2001 | Yu et al. |

(Continued)

OTHER PUBLICATIONS http://www.sabic.com/asia/en/newsandmediarelations/news/20070521.aspx.*

(Continued)

*Primary Examiner* — Jonathan Jelsma
(74) *Attorney, Agent, or Firm* — Pillsbury Winthrop Shaw Pittman LLP

(57) ABSTRACT

The presently disclosed embodiments relate generally to a flexible imaging member having a novel ground strip layer. The flexible imaging member may have a full flexible imaging member structure with an anticurl backing coating (ACBC) as well as a structurally simplified flexible imaging member being ACBC-free.

24 Claims, 4 Drawing Sheets

(56) References Cited

U.S. PATENT DOCUMENTS

| | | | | |
|---|---|---|---|---|
| 6,214,514 | B1 | 4/2001 | Evans et al. | |
| 6,756,169 | B2 | 6/2004 | Lin et al. | |
| 6,933,089 | B2 | 8/2005 | Horgan et al. | |
| 7,018,756 | B2 | 3/2006 | Pai et al. | |
| 7,033,714 | B2 | 4/2006 | Horgan et al. | |
| 7,413,835 | B2 | 8/2008 | Lin et al. | |
| 8,263,298 | B1 * | 9/2012 | Yu et al. | 430/59.6 |
| 8,465,892 | B2 * | 6/2013 | Yu | 430/66 |
| 8,470,505 | B2 * | 6/2013 | Yu et al. | 430/59.6 |
| 8,475,983 | B2 * | 7/2013 | Yu et al. | 430/66 |
| 8,603,710 | B2 * | 12/2013 | Yu | 430/69 |
| 2007/0065740 | A1 * | 3/2007 | Kim et al. | 430/59.5 |
| 2009/0253056 | A1 * | 10/2009 | Yu | 430/58.05 |
| 2009/0253060 | A1 * | 10/2009 | Yu | 430/58.8 |
| 2009/0253062 | A1 * | 10/2009 | Yu | 430/58.75 |
| 2010/0279218 | A1 * | 11/2010 | Yu et al. | 430/58.8 |
| 2010/0279219 | A1 * | 11/2010 | Yu et al. | 430/58.8 |
| 2010/0297544 | A1 * | 11/2010 | Yu et al. | 430/56 |
| 2010/0304285 | A1 * | 12/2010 | Yu et al. | 430/58.8 |
| 2011/0256474 | A1 * | 10/2011 | Yu et al. | 430/56 |
| 2011/0305981 | A1 * | 12/2011 | Yu et al. | 430/56 |
| 2012/0003575 | A1 * | 1/2012 | Yu et al. | 430/56 |
| 2012/0219893 | A1 * | 8/2012 | Yu et al. | 430/58.8 |
| 2012/0237862 | A1 * | 9/2012 | Yu | 430/56 |

OTHER PUBLICATIONS

U.S. Appl. No. 12/762,257, filed Apr. 16, 2010, Robert C. U. Yu et al.

* cited by examiner

FLEXIBLE IMAGING MEMBERS COMPRISING IMPROVED GROUND STRIP

BACKGROUND

The presently disclosed embodiments relate in general to electrostatography comprising improved features in the flexible imaging member that enhance function when used in the electrostatographic imaging system. These embodiments pertain, more particularly, to two ground strip layer design variances to respectively meet two specific flexible electrostatographic imaging member belts need for dynamic belt cyclic motion quality improvement and service life extension in electrostatography.

Flexible electrostatographic imaging members are known in the art. Typical flexible electrostatographic imaging members include (1) flexible electrophotographic imaging members or flexible photoreceptors for electrophotographic imaging systems and (2) flexible electroreceptors such as flexible ionographic imaging members for electrographic imaging systems. Generally, these imaging members comprise at least a flexible supporting substrate and at least one imaging layer comprising a thermoplastic polymeric matrix material coated over the flexible substrate. In a flexible electrophotographic imaging member or photoreceptor, the photoconductive imaging layer may comprise only a single photoconductive layer or multiple of layers such as a combination of a charge generating layer and one or more charge transport layer(s). Whereas in a flexible electroreceptor, the imaging layer is a dielectric imaging layer. For all these flexible electrophotographic imaging members, they can have a number of distinctively different configurations; for example, they can be in the form, such as a flexible scroll or a flexible belt each containing a flexible substrate.

Even though the flexible electrostagraphic imaging members of the present embodiments relate to both electrophotographic imaging members (or photoreceptors) and ionographic imaging members (electroreceptors) in any respective flexible configuration, for reason of simplicity, all disclosed embodiments detailed hereinafter will be focused and primarily represented by negatively charged flexible electrophotographic imaging member belts prepared to consist of two structurally distinctive designs, for use in electrophotography. The two designs are for a full imaging member belt structure and a structurally simplified imaging belt.

For a full imaging member belt structure, the flexible electrophotographic imaging member belts are generally prepared in a seamed or seamless belt configuration. Flexible electrophotographic imaging member seamed belts are typically fabricated from a sheet which is cut from a flexible imaging member web stock. The sheets are generally rectangular in shape. The edges may be of the same length or one pair of parallel edges may be longer than the other pair of parallel edges. The sheets are formed into a belt by joining overlapping opposite marginal end regions of the sheet. A seam is typically produced in the overlapping marginal end regions at the point of joining. Joining may be effected by any suitable means. Typical joining techniques include welding (including ultrasonic), gluing, taping, pressure heat fusing, and the like. Ultrasonic welding is generally the more desirable method of joining because it is rapid, clean (no solvents) and produces a thin and narrow seam. In addition, ultrasonic welding is more desirable because it causes generation of heat at the contiguous overlapping end marginal regions of the sheet to maximize melting of one or more layers to produce a strong fusion bonded seam. The prepared flexible imaging member seamed belt is mounted over and encircled around a belt support module comprising numbers of belt support rollers and backer bars ready for electrophotographic imaging function. The flexible electrophotographic imaging member seamed belt is imaged by uniformly depositing an electrostatic charge on the imaging surface of the electrophotographic imaging member and then exposing the imaging member to a pattern of activating electromagnetic radiation, such as light, which selectively dissipates the charge in the illuminated areas of the imaging member while leaving behind an electrostatic latent image in the non-illuminated areas. This electrostatic latent image may then be developed to form a visible image by depositing finely divided electroscopic marking toner particles on the imaging member surface. The resulting visible toner image can then be transferred to a suitable receiving member or substrate such as paper. Therefore, under these normal machine operation conditions in the field, the flexible imaging member seamed belt is in dynamic fatigued cyclic motion during electrophotographic image printing processes.

In a fully structured imaging member belt design, the charge transport layer and its adjacent ground strip layer are the two top outermost layers that are constantly exposed to the environment contaminants as well as machine subsystems mechanical interactions such as cleaning device actions during electrophotographic imaging processes. Likewise, the anticurl back coating, as the bottom outermost exposed layer, is also subjected to belt support module components mechanical action under dynamic belt cycling function condition. As a consequence, these interactions have been seen to cause and exacerbate the early development of charge transport layer material failures in the belt, causing copy printout defects to prematurely cut short its service life prior to reaching the intended belt life target. Moreover, the bottom outermost exposed the anticurl back coating is constantly subjected to belt support rollers and backer bars mechanical interactions which promotes on-set of premature anticurl back coating wear and abrasion streaking failures.

Since a typical flexible electrophotographic imaging member exhibits spontaneous upward imaging member curling after completion of solution coating the top outermost exposed charge transport layer, an anticurl back coating is applied to the back side of the flexible substrate support to counteract/balance the curl and provide the desirable imaging member flatness.

A large number of the current flexible electrophotographic imaging member belts, that are used in a typical negatively charged xerographic imaging machine design, are multilayered photoreceptor belts comprising a flexible substrate support, an electrically conductive layer, an optional charge blocking layer, an optional adhesive layer, a charge generating layer, a top outermost charge transport layer having a co-coated ground strip layer (for electrical connectivity to the conductive layer) applied adjacent to the charge transport layer and at one edge of the belt, and an anticurl back coating at the opposite side of the substrate support. Since these flexible electrophotographic imaging member belts always exhibit upward curling after completing the solution application coating process of a charge transport layer and co-coated ground strip layer, the anticurl back coating is needed and applied on the back side of the flexible substrate support, opposite from the electrically active layers, to balance/control the curl and render imaging member belt flatness.

Although the application of an anticurl back coating is effective to counter and remove the curl, nonetheless the prepared flat imaging member web does have charge transport layer tension build-up creating an internal strain of about 0.27% in the charge transport layer and also in the ground strip layer as well. The magnitude of this charge transport layer internal strain build-up is very undesirable, because it is additive to the induced bending strain of an imaging member belt as the belt dynamically bends and flexes over each belt support roller during dynamic fatigue belt cyclic motion under a normal machine electrophotographic imaging function condition in the field. The summation of the internal strain and the cumulative fatigue bending strain sustained in the charge transport layer has been found to exacerbate the early onset of charge transport layer cracking, preventing the belt to reach its targeted functional imaging life. Moreover, employing an anticurl backing coating adds to the total belt thickness and increases charge transport layer bending strain which then exacerbates the early onset of belt cycling fatigue charge transport layer cracking failure. The cracks formed in the charge transport layer as a result of dynamic belt fatiguing are found to manifest themselves into copy print-out defects, which adversely affect the image quality printout on the receiving paper.

Various belt function deficiencies have also been observed in these common anticurl back coating formulations used in a typical conventional imaging member belt, such as the anticurl back coating does not always providing satisfying dynamic imaging member belt performance result under a normal machine functioning condition; for example, exhibition of anticurl back coating wear and its propensity to cause electrostatic charging-up are the frequently seen problems to prematurely cut short the service life of a belt and requires its frequent costly replacement in the field. Anticurl back coating wear under the normal imaging member belt machine operational conditions reduces the anticurl back coating thickness, causing the loss of its ability to fully counteract the curl as reflected in exhibition of gradual imaging member belt curling up in the field. Curling, caused by the internal strain in the charge transport layer and the ground strip layer, is undesirable during photoreceptor belt function, because different segments of the imaging surface of the photoconductive member are located at different distances from charging devices, causing non-uniform charging. In addition, developer applicators and the like, during the electrophotographic imaging process, may all adversely affect the quality of the ultimate developed images. For example, non-uniform charging distances can manifest as variations in high background deposits during development of electrostatic latent images near the edges of paper. Since the anticurl back coating is an outermost exposed backing layer and has high surface contact friction when it slides over the machine subsystems of belt support module, such as rollers, stationary belt guiding components, and backer bars, during dynamic belt cyclic function, these mechanical sliding interactions against the belt support module components not only exacerbate anticurl back coating wear, it does also cause the relatively rapid wearing away of the anticurl back coating produce debris which scatters and deposits on critical machine components such as lenses, corona charging devices and the like, thereby adversely affecting machine performance. Moreover, anticurl back coating abrasion/scratch damage does also produce unbalance forces generation between the charge transport layer and the anticurl back coating to cause micro belt ripples formation during electrophotographic imaging processes, resulting in streak line print defects in output copies to deleteriously impact image printout quality and shorten the imaging member belt functional life.

High contact friction of the anticurl back coating against machine subsystems is further seen to cause the development of electrostatic charge built-up problem. In other machines the electrostatic charge builds up due to contact friction between the anti-curl layer and the backer bars increases the friction and thus requires higher torque to pull the belts. In full color machines with 10 pitches this can be extremely high due to large number of backer bars used. At times, one has to use two drive rollers rather than one which are to be coordinated electronically precisely to keep any possibility of sagging. Static charge built-up in anticurl back coating increases belt drive torque, in some instances, has also been found to result in absolute belt stalling. In other cases, the electrostatic charge build up can be so high as to cause sparking.

Another problem, encountered in the conventional belt photoreceptors using a bisphenol A polycarbonate anticurl back coating that are extensively cycled in precision electrophotographic imaging machines utilizing belt supporting backer bars, is an audible squeaky sound generated due to high contact friction interaction between the anticurl back coating and the backer bars. Further, cumulative deposition of anticurl back coating wear debris onto the backer bars may give rise to undesirable defect print marks formed on copies because each debris deposit become a surface protrusion point on the backer bar and locally forces the imaging member belt upwardly to interferes with the toner image development process.

Thus, electrophotographic imaging member belts comprising a supporting substrate, having a conductive surface on one side, coated over with at least one photoconductive layer (such as the outermost charge transport layer) having a co-coated adjacent ground strip layer at one edge of the belt, and the application on the other side of the supporting substrate with a conventional anticurl back coating that does exhibit deficiencies which are undesirable in advanced automatic, cyclic electrophotographic imaging copiers, duplicators, and printers. While the above mentioned electrophotographic imaging member belts may be suitable or limited for their intended purposes, further improvement on these imaging member belts are needed. For example, there continues to be the need for improvements in such systems, particularly for an imaging member belt that has sufficiently flatness, superb wear resistance, nil or no wear debris, ease of belt drive, and eliminates electrostatic charge build-up problem, even in larger printing apparatuses. With many of above mentioned shortcomings and problems associated with electrophotographic imaging member belts having an anticurl back coating now understood, therefore there is a need to resolve these issues through the development of a methodology for fabricating imaging member belts that produce improve function and meet future machine imaging member belt life extension need.

More recently, to overcome the shortcomings associated with the anticurl back coating function, flexible electrophotographic imaging member belts have been successfully redesigned to give a structurally simplified configuration to give flatness without the need of an anticurl back coating. In these structurally simplified imaging belts, incorporation of a high boiler liquid plasticizer into the top outermost exposed charge transport layer of the negatively charge imaging member belt helps provide the reduction/elimination of dimensional contraction differential between the charge transport layer and the flexible substrate support which relieves the internal strain build-up in the charge transport layer to suppress the curl-up tension stress. Similarly, the ground strip layer likewise incorporates a plasticizer as described in the charge transport layer to render the resulting imaging member with desired flatness.

Conventional photoreceptors are disclosed in the following patents, a number of which describe the presence of light scattering particles in the undercoat layers: Yu, U.S. Pat. No.

5,660,961; Yu, U.S. Pat. No. 5,215,839; and Katayama et al., U.S. Pat. No. 5,958,638. The term "photoreceptor" or "photoconductor" is generally used interchangeably with the terms "imaging member."

Horgan et al., U.S. Pat. No. 4,664,995 issued on May 12, 1987, discloses an electrostatographic imaging member comprising at least one imaging layer capable of retaining an electrostatic latent image, a supporting substrate layer having an electrical conductive surface, and an electrically conductive ground strip layer adjacent the electrostographic imaging layer and in electrical contact with the electrical conductive layer, the electrical conductive ground strip layer comprising a film forming binder, conductive particles and crystalline particles dispersion in the film forming binder and a reaction product of a bifunctional chemical coupling agent with both the film forming binder and the crystalline particles. The imaging member may be employed in an electrostatographic imaging process.

Yu, U.S. Pat. No. 6,183,921 issued on Feb. 6, 2001, discloses a crack resistant and curl-free electrophotographic imaging member design which includes a charge transport layer comprising an active charge transporting polymeric tetraaryl-substituted biphenyldiamine, and a plasticizer.

In U.S. Pat. No. 7,413,835 issued on Aug. 19, 2008, there is disclosed an electrophotographic imaging member having a thermoplastic charge transport layer, a polycarbonate polymer binder, a particulate dispersion, and a high boiler compatible liquid. The disclosed charge transport layer exhibits enhanced wear resistance, excellent photoelectrical properties, and good print quality.

In U.S. patent application Ser. No. 12/762,257 to R. Yu et al., entitled Imaging Members Having Stress/Strain Free Layers, discloses embodiments comprising improved features in the flexible imaging member that enhance function when used in the electrostatographic imaging system. These embodiments pertain, more particularly, to a structurally simplified curl-free flexible electrostatographic imaging member belt containing a stress/strain free ground strip layer and stress/strain free imaging layer(s) to improve dynamic belt cyclic motion quality and extend service life.

All the above-disclosed prior art electrophotographic imaging members belts, however, either having a full imaging member structure that includes an anticurl back coating or a structurally simplified curl-free design that requires no anticurl back coating, do each comprise a top outermost exposed ground strip layer (co-coated adjacent to the charge transport layer to effect electrical connectivity between the photo-electrically active layers in the members) that exhibits deficiencies and shortfalls which are undesirable in advanced automatic, cyclic electrophotographic imaging copiers, duplicators, and printers and therefore needs improvement.

SUMMARY

According to aspects illustrated herein, there is provided a flexible imaging member comprising: a flexible substrate; a charge generating layer disposed on a first side of the substrate; at least one charge transport layer disposed on the charge generating layer; and an electrically conductive ground strip layer disposed adjacent to the charge transport layer and at an edge of the imaging member, wherein the ground strip layer comprises a film forming polycarbonate binder being a A-B diblock copolymer binder having a formula selected from the group consisting of Formula A

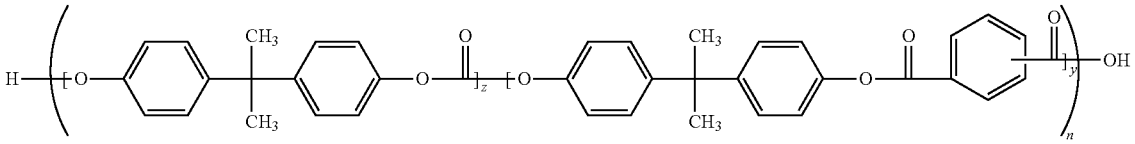

Block (A) Block (B)

Formula B

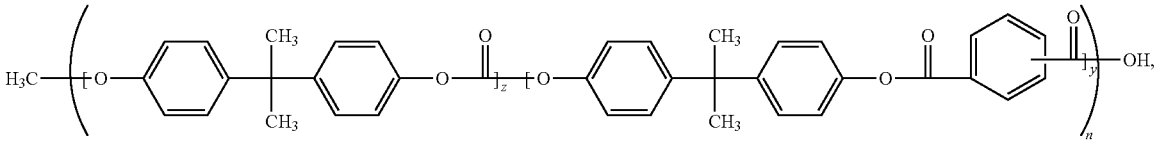

Block (A) Block (B)

and mixtures thereof, wherein z represents the number of bisphenol A repeating units of block (A) and is from about 9 to about 18, y is number of repeating phthalic acid in block (B) and is from about 1 to about 2, and n is the degree of polymerization and is between about 20 and about 80, an electrically conductive particle dispersion, and an optional additive comprising organic or inorganic particle dispersion.

In yet further embodiments, there is provided a flexible substrate; a charge generating layer disposed on a first side of the substrate; at least one charge transport layer disposed on the charge generating layer, wherein the charge transport layer comprises a charge transport compound and a plasticizing liquid compound having a high boiling point; and a ground strip layer disposed adjacent to the charge transport layer and at an edge of the imaging member, wherein the ground strip layer comprises a film forming polycarbonate binder being a A-B diblock copolymer binder having a formula selected from the group consisting of Formula A

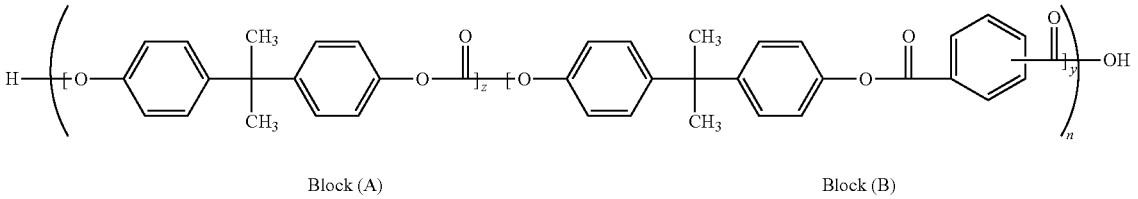

Formula B

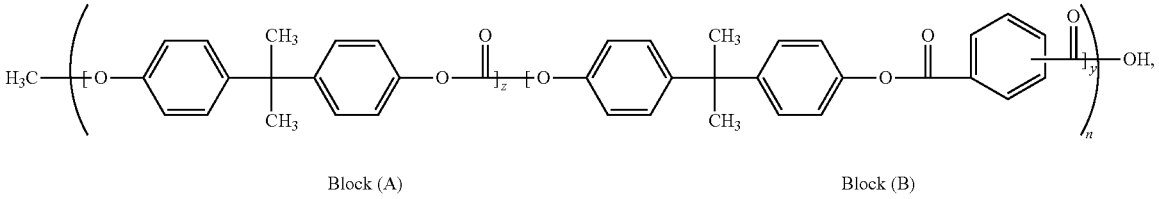

and mixtures thereof, wherein z represents the number of bisphenol A repeating units of block (A) and is from about 9 to about 18, y is number of repeating phthalic acid in block (B) and is from about 1 to about 2, and n is the degree of polymerization and is between about 20 and about 80, the high boiling plasticizing liquid compound, an electrically conductive particle dispersion, and an optional additive comprising organic or inorganic particle dispersion.

In yet further embodiments, there is provided a flexible imaging member comprising: a flexible substrate; a charge generating layer disposed on a first side of the substrate; multiple charge transport layers disposed on the charge generating layer, wherein each of the multiple charge transport layers comprise a charge transport compound and plasticizing liquid compound having a high boiling point; and a ground strip layer disposed adjacent to the multiple charge transport layers and at an edge of the imaging member, wherein the ground strip layer comprises a film forming polycarbonate binder being a A-B diblock copolymer binder having a formula selected from the group consisting of Formula A

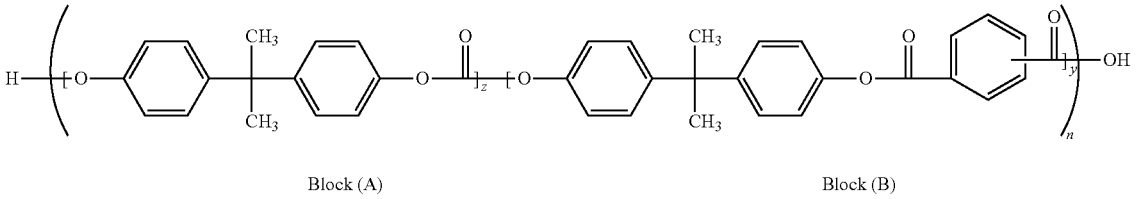

Formula B

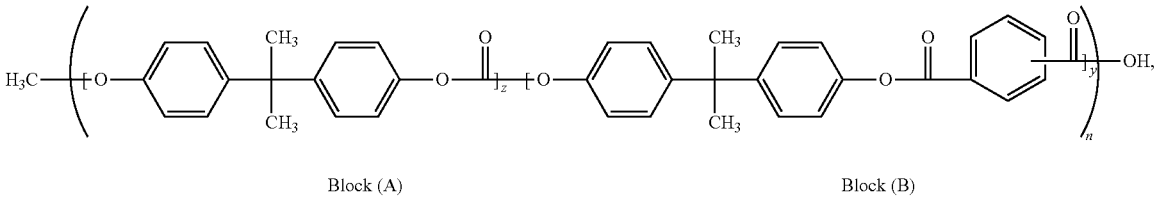

and mixtures thereof, a plasticizing liquid having a high boiling point, a carbon black or graphite dispersion, and an optional additive comprising organic or inorganic particle dispersion.

BRIEF DESCRIPTION OF THE DRAWINGS

For a better understanding of the present disclosure, reference may be made to the accompanying figures.

DETAILED DESCRIPTION

Figure 1:
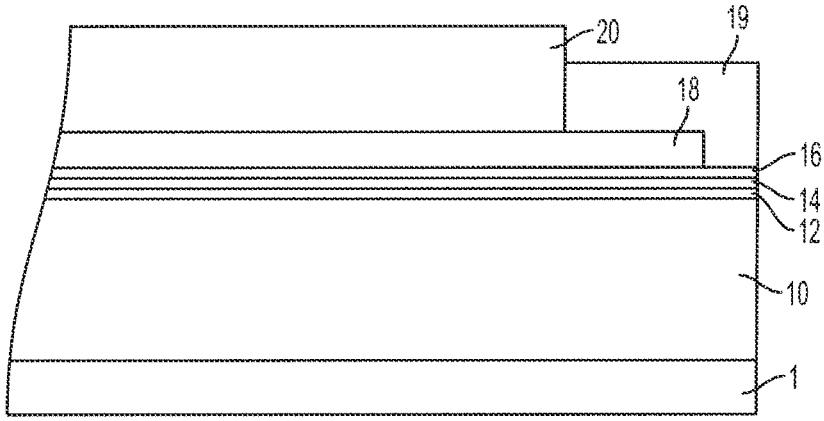
FIG. 1 is a cross-sectional view of a typical flexible multilayered electrophotographic imaging member, having the configuration of a full structural design, prepared to comprise a ground strip layer of present disclosure by following the description of conventional procedures.

In the following description, methods for making a novel ground strip layer for both conventional flexible full imaging member structures and the alternative curl-free structurally simplified imaging members are described. Reference is made to the accompanying drawings, which form a part hereof and illustrate several disclosed embodiments in thorough detail. It is understood that other embodiments may be utilized and structural and operational changes may also be made without departure from the scope of the illustrative embodiments of present disclosure.

In the present disclosure, methodology and material compositions used for reformulations of novel and functionally improved ground strip layers are developed and specified in detail to meet the specific requirements for the two distinctive flexible electrophotographic imaging member belt designs described above. In the present embodiments, the ground strip layer reformulated for (1) the full imaging member flexible belt structure and (2) the structurally simplified curl-free electrophotographic imaging member belt. For the fully structured flexible imaging member disclosed in the embodiments, the ground strip layer is formulated to comprise of two material compositions; namely: (1) a film forming A-B diblock copolymer, an ethyl cellulose, an electrically conductive species consisting of graphite dispersion, and an inorganic or organic particle dispersion; and (2) a film forming A-B diblock copolymer, an electrically conductive carbon black, and an inorganic or organic particle dispersion. In the ACBC-free structurally simplified imaging members, the two ground strip layer material compositions are re-formulated and prepared to comprise: (1a) a film forming A-B diblock copolymer, an ethyl cellulose, an electrically conductive species consisting of graphite dispersion, an inorganic or organic particle dispersion, and with the incorporation of a liquid plasticizer; and (2b) a film forming A-B diblock copolymer, an electrically conductive carbon black, an inorganic or organic particle dispersion, and with the incorporation of a liquid plasticizer.

Ground Strip Layer Formulation I

For a typical negatively charged full imaging member belt structure, a ground strip layer formulation I is formulated to comprise a novel A-B diblock copolymer binder and a conductivity carbon dispersion. The A-B diblock copolymer selected for use comprises a bisphenol A polycarbonate segment block (A) and a phthalic acid containing segment block (B) terminal. Specific embodiments are shown below by Formulas A and B and are polymers available from Sabic Innovative Plastics (Pittsfield, Mass.) having a Mw of 115,000.

Formula A

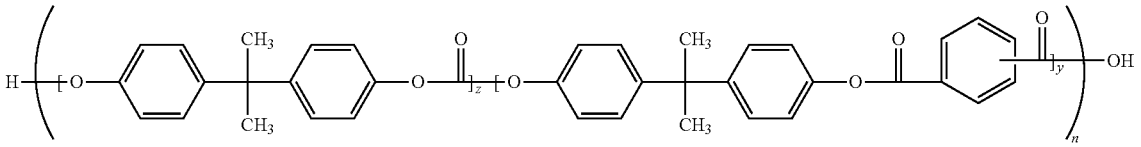

Block (A) Block (B)

-continued

Formula B

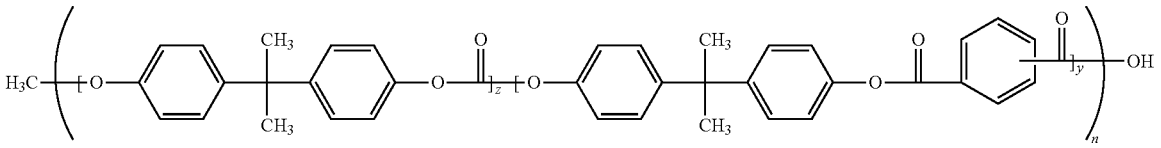

Block (A) Block (B)

In the above Formulas A and B, z represents the number of bisphenol A repeating units of block (A) and is from about 9 to about 18, y is number of repeating phthalic acid in block (B) and is from about 1 to about 2, and n is the degree of polymerization. In embodiments, the degree of polymerization of the diblock copolymer, n, is between about 20 and about 80 and the copolymer has a molecular weight of between about 100,000 and about 200,000.

Ground Strip Formulation II

The negatively charged structurally simplified curl-free electrophotographic imaging member belt is derived from the same full imaging member belt structure but with the exception that the charge transport layer is incorporated with a liquid plasticizer to reduce/minimize its internal tension stress for curl control without the need for an anticurl back coating. However, to complement and match the plasticized charge transport layer effect, the disclosed ground strip layer formulation I (described above) is likewise included with a liquid plasticizer to give the ground strip layer formulation II of the present embodiments. In this manner, the imaging member is provided with flatness in both the belt and the cross-belt directions.

As such, the ground strip formulations I and II provides an imaging member with extended service life and function. To provide impact wear resistance enhancement, the ground strip layer formulations I and II may also include an inorganic or organic particle dispersion. The described novel ground strip layers may be applicable for flexible imaging members in all varieties of form and configurations.

According to aspects of embodiments illustrated herein, there is provided a conventional flexible full imaging member structure which comprising a flexible imaging member comprising a flexible substrate, a charge generating layer (CTL) disposed on the substrate, at least one charge transport layer disposed on the charge generating layer (CGL), and a ground strip layer disposed adjacent to the CTL and at an edge of the imaging member, wherein the CTL comprises a film forming polycarbonate binder and a charge transport compound of N,N'-diphenyl-N,N'-bis(3-methylphenyl)-1,1-biphenyl-4,4'-diamine (m-TBD), and an anticurl back coating (ACBC) applied to the backside (opposite to the side of photoelectrical active layers) of the substrate to render imaging member flatness. The ground strip layer of this disclosure comprises a novel film forming A-B diblock copolymer and an electrically conductive carbon black or a graphite dispersion; alternatively, the disclosed ground strip layer of a flexible imaging member comprises a novel film forming A-B diblock copolymer, a carbon black or a graphite dispersion, and plus the inclusion of an inorganic or organic particle dispersion to enhance it mechanical wear resistance.

The film forming A-B diblock copolymer selected for use comprise a bisphenol A polycarbonate segment block (A) and a phthalic acid containing segment block (B) terminal. Specific embodiments are shown in Formulas A and B below, wherein z represents the number of bisphenol A repeating units of block (A) and is from about 9 to about 18, y is number of repeating phthalic acid in block (B) and is from about 1 to about 2, and n is the degree of polymerization. In embodiments, the degree of polymerization of the diblock copolymer, n, is between about 20 and about 80 and the copolymer has a molecular weight of between about 100,000 and about 200,000.

Formula A

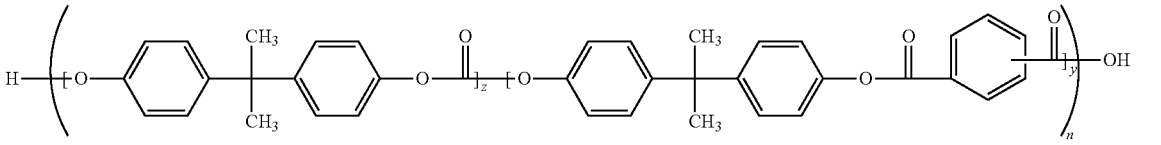

Block (A) Block (B)

Formula B

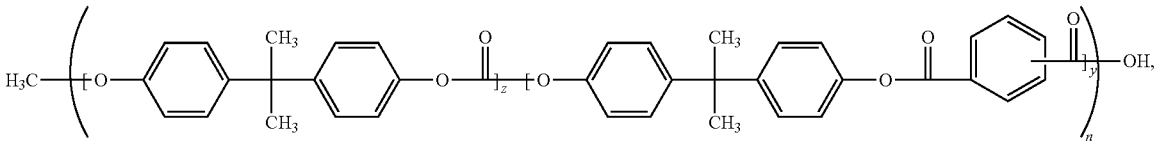

Block (A) Block (B)

According to another aspects of embodiments illustrated herein, there is provided a structurally simplified, ACBC-free flexible imaging member comprising a flexible imaging member comprising a flexible substrate, a CGL disposed on the substrate, a dual layered CTL having a bottom CTL and a top CTL with the bottom CTL disposed on the CGL, and a ground strip layer disposed adjacent to the dual CTL and at an edge of the imaging member, wherein the dual CTL each comprises a film forming polycarbonate binder, a N,N'-diphenyl-N,N'-bis(3-methylphenyl)-1,1-biphenyl-4,4'-diamine charge transport compound, and an organic plasticizing liquid compound having a high boiling point (for example, at least 200° C. or from about 200° C. to about 350° C.), wherein the ground strip layer of this disclosure is a specifically modified re-composition comprising the film forming A-B diblock copolymer and the electrically conductive carbon black or a graphite dispersion, and the same organic plasticizing liquid. In yet another aspect illustrated, the disclosed ground strip layer of the structurally simplified ACBC free flexible imaging member is re-compositioned to comprise the novel film forming A-B diblock copolymer, the electrically conductive carbon black or a graphite dispersion, the organic plasticizing liquid, and further including an inorganic or organic particle dispersion.

In yet another aspect of illustrative embodiments, there is provided a structurally simplified ACBC-free imaging member of this disclosure comprising a substrate, a CGL disposed on the substrate, and multiple CTLs having the bottom layer disposed onto the COL, and a co-coated adjacent ground strip layer to the CTLs at one edge of the imaging member. The multiple CTLs comprise a film forming polycarbonate binder, a charge transport compound of N,N'-diphenyl-N,N'-bis(3-methylphenyl)-1,1'-biphenyl-4,4'-diamine, and a plasticizing liquid compound having a high boiling point, and being miscible/compatible with both the polycarbonate binder and N,N'-diphenyl-N,N'-bis(3-methylphenyl)-1,1'-biphenyl-4,4'-diamine. The ground strip layer is comprised of film forming polycarbonate, conductive species consisting of carbon black or graphite dispersion, a plasticizer, and an organic or inorganic particle dispersion.

In a further aspect of illustrative embodiment, there is provided a specific structurally simplified ACBC-free imaging member of this disclosure comprising a substrate and a single imaging layer disposed on the substrate, wherein the single imaging layer disposed on the substrate has both charge generating and charge transporting capability and further wherein the single imaging layer comprises a film forming polycarbonate binder and N,N'-diphenyl-N,N'-bis(3-methylphenyl)-1,1'-biphenyl-4,4'-diamine charge transport compound, a charge generating pigment, and a plasticizing liquid compound having a high boiling point. The disclosed ground strip layer is comprised of a film forming A-B diblock copolymer, a conductive species consisting of carbon black or graphite dispersion, a plasticizer, and an organic or inorganic particles dispersion.

The high boiler organic plasticizing liquid is selected from the group consisting of bisphenol carbonate liquids and oligomeric styrenes, fluoro-containing compounds, and mixtures thereof, capable of providing surface energy reduction effect. The disclosed ground strip may further include a silica particle or polytetrafluoro ethylene (PTFE) particle dispersion.

Organic Liquid Plasticizers

The amount of organic liquid plasticizer 26 incorporated, to impact satisfactory internal stress/strain relief for imaging member curl control and suppression, is from about 3 to about 30 weight percent, based on the total weight of the respective CTL and ground strip layer. In specific embodiments, the amount is between about 5 and about 12 weight percent to impart optimum plasticizing outcome without causing photoelectrical property degradation of the resulting imaging member; that is to substantially depress the Tg of the plasticized CTL, such that the magnitude of (Tg−25° C.) becomes a small value to substantially impact the CTL/ground strip layer internal strain building up reduction, according to equation (1), and provides effective imaging member curling control.

The organic liquid phthalates 26 of the present embodiments are represented by the following:

Formula (I)

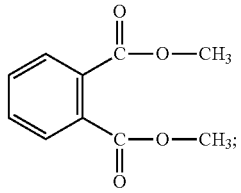

Formula (IA)

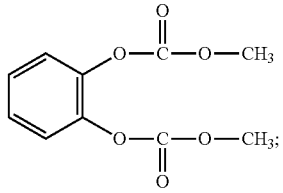

Formula (II)

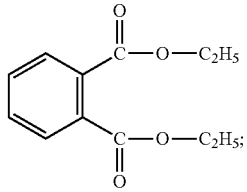

Formula (IIA)

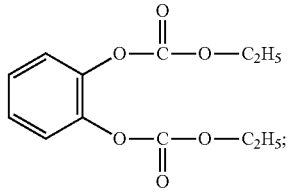

Formula (III)

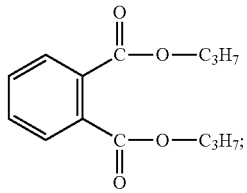

Formula (IV)

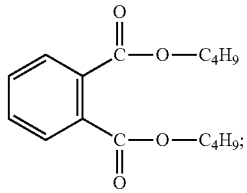

-continued

Formula (V)

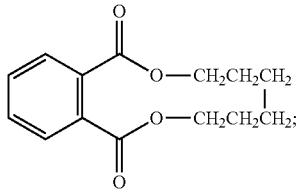

Formula (VI)

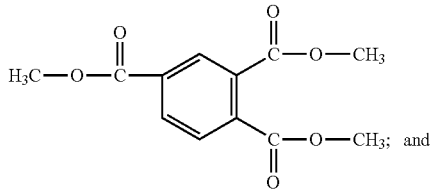

Formula (VII)

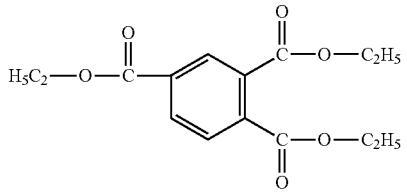

The monomeric carbonates liquid 26 is represented by the following:

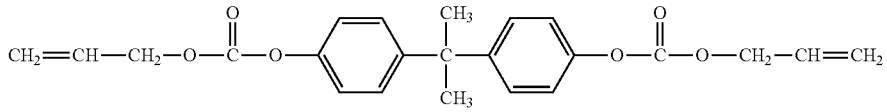

For extension of the present disclosure, alternate plasticizing carbonate liquids that are also viable for incorporation into the charge transport layer according to the present embodiments may be conveniently derived from Formula (1) to give molecular structures described in the following Formulas (2) to (5):

Formula (2)

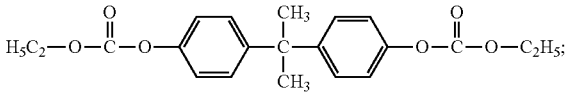

Formula (3)

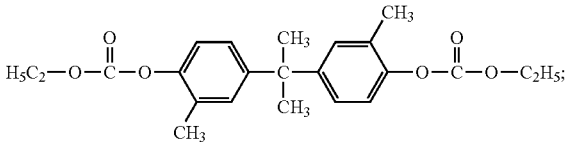

Formula (4)

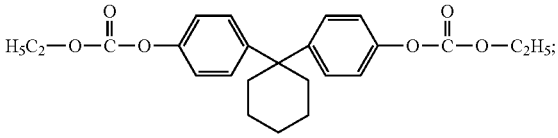

-continued

Formula (5)

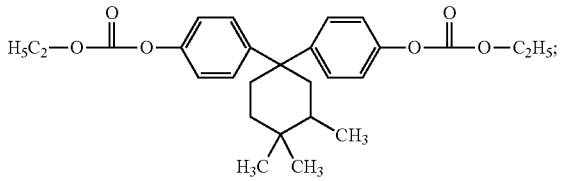

and the diethylene glycol bis(allyl carbonate) liquid of Formula (6):

Formula (6)

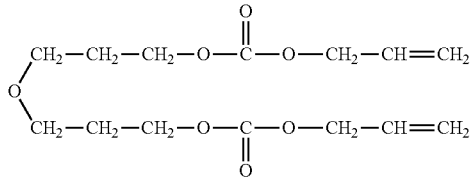

An oligomeric polystyrene liquid 26 chosen for charge transport layer and ground strip layer plasticizing use has a molecular structure shown in Formula (C) below:

Formula (C)

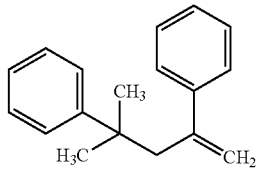

An alternate oligomeric polystyrene is a modified structure derived from Formula (C) to give a methyl styrene dimer liquid of Formula (D) shown below:

Formula (D)

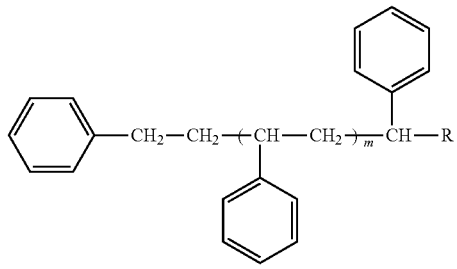

where R is selected from the group consisting of H, $CH_3$, $CH_2CH_3$, and $CH{=}CH_2$, and where m is between 0 and 3.

Fluoro-Containing Organic Liquids

The fluoro-containing organic liquids 28 are to be used not only to render plasticizing effect for eliminating the CTL/ground strip layer internal stress/strain build-up for curl control, but also to provide a surface energy reduction effect to impact surface slipperiness enhancement in the resulting CTL/ground strip layer. Therefore, the fluoro-organic liquids used for CTL/ground strip layer plasticizing application are primarily selected from fluoroketones. These compounds are, in specific embodiments, 3-(trifluoromethyl)phenylacetone, 2'-(trifluoromethyl)propiophenone, 2,2,2-trifluoro-2',4'-dimethoxyacetophenone, 3',5'-bis(trifluoromethyl)acetophenone, 3'-(trifluoromethyl)propiophenone, 4'-(trifluoromethyl)propiophenone, 4,4,4-trifluoro-1-phenyl-1,3-butanedione, 4,4-difluoro-1-phenyl-1,3-butanedione, and mixtures thereof, having the molecular structures shown below:

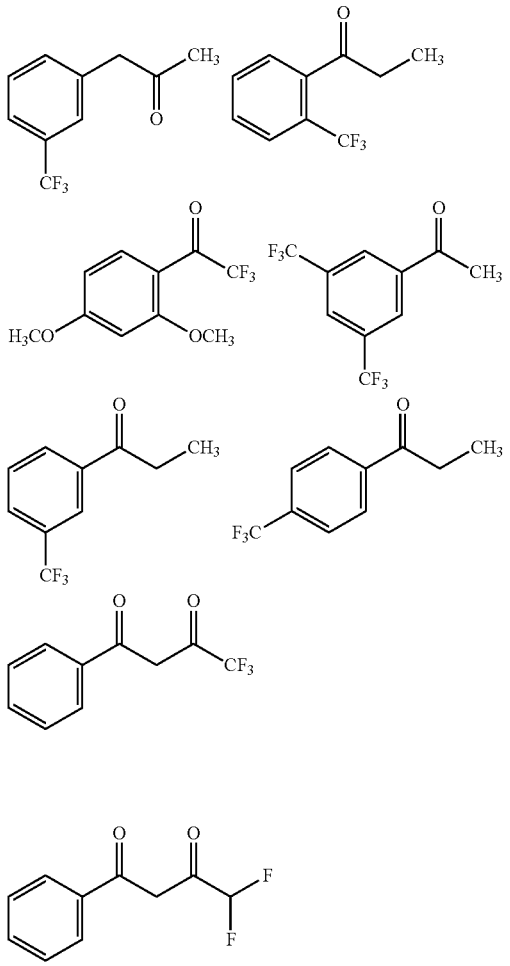

The amount of plasticizing fluoro-containing organic liquid 28 selected from one of the above for incorporation is again from about 3 to about 30 weight percent, based on the total weight of the respective CTL or the ground strip layer. In specific embodiments, between about 5 and about 12 weight percent to impart optimum plasticizing outcome without causing photoelectrical property degradation of the resulting imaging member nor deleterious electrical conductivity impact of the ground strip layer.

In summary, there is provided two flexible imaging member designs—one having a full flexible imaging member structure having an ACBC and a ground strip layer formulation I and a structurally simplified flexible imaging member being ACBC-free and having a ground strip layer formulation II. The ground strip layer formulation I is prepared to comprise a film forming A-B diblock copolymer, a conductive species consisting of carbon black or graphite dispersion, and an inorganic organic particle dispersion while the ground strip layer formulation II comprises a film forming A-B diblock copolymer, a conductive species consisting of carbon black or graphite dispersion, a plasticizer, and an inorganic organic particle dispersion.

An exemplary embodiment of a conventional negatively charged flexible electrophotographic imaging member having a full structure configuration is illustrated in FIG. 1. The flexible substrate 10 has an optional conductive layer 12. An optional hole blocking layer 14 disposed onto the conductive layer 12 is coated over with an optional adhesive layer 16. The CGL 18 is located between the adhesive layer 16 and the CTL 20. An optional ground strip layer 19 operatively connects the CGL 18 and the CTL 20 to the conductive ground plane 12. An ACBC 1 is applied to the side of the substrate 10 opposite from the electrically active layers to render imaging member flatness.

The layers of the imaging member include, for example, an optional ground strip layer 19 that is applied to one edge of the imaging member to promote electrical continuity with the conductive ground plane 12 through the hole blocking layer 14. The conductive ground plane 12, which is typically a thin metallic layer, for example a 10 nanometer thick titanium coating, may be deposited over the substrate 10 by vacuum deposition or sputtering process. The other layers 14, 16, 18, and 20 are to be separately and sequentially deposited, onto to the surface of conductive ground plane 12 of substrate 10 respectively, as wet coating layer of solutions comprising a solvent, with each layer being dried before deposition of the next subsequent one. An ACBC 1 may then be formed on the backside of the support substrate 1. The ACBC 1 is also solution coated, but is applied to the back side (the side opposite to all the other layers) of substrate 1, to render imaging member flatness.

The Flexible Substrate

The imaging member support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The support substrate 10 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate (PEN) available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate may have a number of many different configurations, such as, for example, a plate, a drum, a scroll, an endless flexible belt, and the like. In one embodiment, the substrate is in the form of a seamed flexible belt.

The thickness of the support substrate 10 depends on numerous factors, including flexibility, mechanical performance, and economic considerations. The thickness of the support substrate may range from about 50 micrometers to about 3,000 micrometers. In embodiments of flexible imaging member belt preparation, the thickness of substrate used is from about 50 micrometers to about 200 micrometers for achieving optimum flexibility and to effect tolerable induced imaging member belt surface bending stress/strain when a belt is cycled around small diameter rollers in a machine belt support module, for example, the 19 millimeter diameter rollers.

An exemplary functioning support substrate 10 is not soluble in any of the solvents used in each coating layer solution, has good optical transparency, and is thermally stable up to a high temperature of at least 150° C. A typical support substrate 10 used for imaging member fabrication has a thermal contraction coefficient ranging from about $1\times10^{-5}$/° C. to about $3\times10^{-5}$/° and also with a Young's Modulus of between about $5\times10^{5}$ psi ($3.5\times10^{4}$ Kg/cm2) and about $7\times10^{5}$ psi ($4.9\times10^{4}$ Kg/cm2).

The Conductive Ground Plane

The conductive ground plane layer 12 may vary in thickness depending on the optical transparency and flexibility desired for the electrophotographic imaging member. For a typical flexible imaging member belt, it is desired that the thickness of the conductive ground plane 12 on the support substrate 10, for example, a titanium and/or zirconium conductive layer produced by a sputtered deposition process, is in the range of from about 2 nanometers to about 75 nanometers to effect adequate light transmission through for proper back erase. In particular embodiments, the range is from about 10 nanometers to about 20 nanometers to provide optimum combination of electrical conductivity, flexibility, and light transmission. For electrophotographic imaging process employing back exposure erase approach, a conductive ground plane light transparency of at least about 15 percent is generally desirable. The conductive ground plane need is not limited to metals. Nonetheless, the conductive ground plane 12 has usually been an electrically conductive metal layer which may be formed, for example, on the substrate by any suitable coating technique, such as a vacuum depositing or sputtering technique. Typical metals suitable for use as conductive ground plane include aluminum, zirconium, niobium, tantalum, vanadium, hafnium, titanium, nickel, stainless steel, chromium, tungsten, molybdenum, combinations thereof, and the like. Other examples of conductive ground plane 12 may be combinations of materials such as conductive indium tin oxide as a transparent layer for light having a wavelength between about 4000 Angstroms and about 9000 Angstroms or a conductive carbon black dispersed in a plastic binder as an opaque conductive layer. However, in the event where the entire substrate is chosen to be an electrically conductive metal, such as in the case that the electrophotographic imaging process designed to use front exposure erase, the outer surface thereof can perform the function of an electrically conductive ground plane so that a separate electrical conductive layer 12 may be omitted.

For the reason of convenience, all the illustrated embodiments herein after will be described in terms of a substrate layer 10 comprising an insulating material including organic polymeric materials, such as, MYLAR or PEN having a conductive ground plane 12 comprising of an electrically conductive material, such as titanium or titanium/zirconium, coating over the support substrate 10.

The Hole Blocking Layer

A hole blocking layer 14 may then be applied to the conductive ground plane 12 of the support substrate 10. Any suitable positive charge (hole) blocking layer capable of forming an effective barrier to the injection of holes from the adjacent conductive layer 12 into the overlaying photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer 14 may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl)gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula [H2N(CH2)4]CH3Si(OCH3)2, and (gamma-aminopropyl) methyl diethoxysilane, which has the formula [H2N(CH2)3] CH33Si(OCH3)2, and combinations thereof, as disclosed, for example, in U.S. Pat. Nos. 4,338,387; 4,286,033; and 4,291,110, incorporated herein by reference in their entireties. A specific hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. patents are incorporated herein by reference in their entireties.

The hole blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The adhesive interface layer 16 may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. However, in some alternative electrophotographic imaging member designs, the adhesive interface layer 16 is entirely omitted.

Any suitable solvent or solvent mixtures may be employed to form a coating solution of the polyester for the adhesive interface layer 16. Typical solvents include tetrahydrofuran, toluene, monochlorbenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The CGL (e.g., charge generating) 18 may thereafter be applied to the adhesive layer 16. Any suitable CGL 18 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ-400 (poly(4,4'-dihydroxy-diphenyl-1-1-cyclohexane) which has a MW=40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer 18 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Charge Transport Layer

The CTL 20 is thereafter applied over the charge generating layer 18 and become, as shown in FIG. 1, the exposed outermost layer of the imaging member. It may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The CTL 20 is normally transparent in a wavelength region in which the electrophotographic imaging member is to be used when exposure is effected therethrough to ensure that most of the incident radiation is utilized by the underlying CGL 18. The CTL should exhibit excellent optical transparency with negligible light absorption and neither charge generation nor discharge if any, when exposed to a wavelength of light useful in xerography, e.g., 400 to 900 nanometers. In the case when the imaging member is prepared with the use of a transparent support substrate 10 and also a transparent conductive ground plane 12, image wise exposure or erase may be accomplished through the substrate 10 with all light passing through the back side of the support substrate 10. In this particular case, the materials of the CTL 20 need not have to be able to transmit light in the wavelength region of use for electrophotographic imaging processes if the charge CGL 18 is sandwiched between the support substrate 10 and the CTL 20. In all events, the top outermost exposed CTL 20 in conjunction with the CGL 18 is an insulator to the extent that an electrostatic charge deposited/placed over the charge transport layer is not conducted in the absence of radiant illumination. Importantly, the CTL 20 should trap minimal or no charges as the charge pass through it during the image copying/printing process.

The CTL 20 is a two components solid solution which may include any suitable charge transport component or charge activating compound useful as an additive molecularly dispersed in an electrically inactive polymeric material to form a solid solution and thereby making this material electrically active. The charge transport compound may be added to a film forming binder of polymeric material which is otherwise incapable of supporting the injection of photo generated holes from the generation material and incapable of allowing the transport of these holes there through. This converts the electrically inactive polymeric material to a material capable of supporting the injection of photogenerated holes from the CGL 18 and capable of allowing the transport of these holes through the CTL 20 in order to discharge the surface charge on the charge transport layer. The charge transport component typically comprises small molecules of an organic compound which cooperate to transport charge between molecules and ultimately to the surface of the CTL.

Any suitable inactive resin binder soluble in methylene chloride, chlorobenzene, or other suitable solvent may be employed in the charge transport layer. Exemplary binders include polyesters, polyvinyl butyrals, polycarbonates, polystyrene, polyvinyl formals, and combinations thereof. The polymer binder used for the charge transport layers may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly (4,4'-isopropylidene diphenyl carbonate), poly(4,4'-diphenyl-1,1'-cyclohexane carbonate), and combinations thereof. The molecular weight of the polymer binder used in the CTL can be, for example, from about 20,000 to about 1,500,000.

Exemplary charge transport components include aromatic polyamines, such as aryl diamines and aryl triamines. Exemplary aromatic diamines include N,N'-diphenyl-N,N'-bis (alkylphenyl)-1,1'-biphenyl-4,4-diamines, such as mTBD, which has the formula (N,N'-diphenyl-N,N-bis[3-methylphenyl]-[1',1'-biphenyl]-4,4'-diamine); N,N'-diphenyl-N, N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987, 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein be reference in their entireties.

The concentration of the charge transport component in CTL 20 may be, for example, at least about 5 weight % and may comprise up to about 60 weight %. The concentration or composition of the charge transport component may vary through layer 20, as disclosed, for example, in U.S. Pat. No. 7,033,714; U.S. Pat. No. 6,933,089; and U.S. Pat. No. 7,018, 756, the disclosures of which are incorporated herein by reference in their entireties.

In one exemplary embodiment, CTL 20 comprises an average of about 10 to about 60 weight percent N,N'-diphenyl-N, N'-bis(3-methylphenyl)-1,1'-biphenyl-4,4'-diamine, or from about 30 to about 50 weight percent N,N'-diphenyl-N,N'-bis (3-methylphenyl)-1,1'-biphenyl-4,4'-diamine.

The CTL 20 is an insulator to the extent that the electrostatic charge placed on the charge transport layer is not conductive in the absence of illumination at a rate sufficient to prevent formation and retention of an electrostatic latent image thereon. In general, the ratio of the thickness of the CTL 20 to the charge generator layer 18 is maintained from about 2:1 to about 200:1 and in some instances as great as about 400:1.

Additional aspects relate to the inclusion in the charge transport layer 20 of variable amounts of an antioxidant, such as a hindered phenol. Exemplary hindered phenols include octadecyl-3,5-di-tert-butyl-4-hydroxyhydrocinnamate, available as IRGANOXI-1010 from Ciba Specialty Chemicals. The hindered phenol may be present at about 10 weight percent based on the concentration of the charge transport component. Other suitable antioxidants are described, for example, in U.S. Pat. No. 7,018,756, which is hereby incorporated by reference.

In one specific embodiment, the CTL 20 is a solid solution including a charge transport compound, such as N,N'-diphenyl-N,N'-bis(3-methylphenyl)-1,1'-biphenyl-4,4'-diamine, molecularly dissolved in a polycarbonate binder, the binder being either a bisphenol A polycarbonate of poly(4,4'-isopropylidene diphenyl carbonate) or a poly(4,4'-diphenyl-1,1'-cyclohexane carbonate). The Bisphenol A polycarbonate used for typical charge transport layer formulation is MAKROLON which is commercially available from Farbensabricken Bayer AG or is the FPC 0170 available from Mitsubishi Chemicals. This commercial bisphenol A polycarbonate, poly(4,4'-isopropylidene diphenyl carbonate), has a molecular weight of about 120,000 to 150,000 and a molecular structure of given in Formula (X) below:

Formula (X)

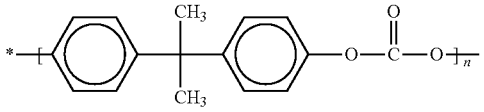

wherein n indicates the degree of polymerization. In the alternative, poly(4,4'-diphenyl-1,1'-cyclohexane carbonate) may also be used to ACBC use in place of MAKROLON or FPC 0170. The molecular structure of poly(4,4'-diphenyl-1,1'-cyclohexane carbonate), having a weight average molecular weight of about between about 20,000 and about 200,000, is given in Formula (Y) below:

Formula (Y)

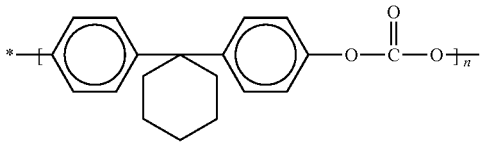

wherein n indicates the degree of polymerization.

Examples of charge transport compounds used in the CTL include, but are not limited to, triphenylmethane; bis(4-diethylamine-2-methylphenyl)phenylmethane; stilbene; hydrazone; an aromatic amine comprising tritolylamine; arylamine; enamine phenanthrene diamine; N,N'-bis(4-methylphenyl)-N,N'-bis[4-(1-butyl)-phenyl]-[p-terphenyl]-4,4'-diamine; N,N'-bis(3-methylphenyl)-N,N'-bis[4-(1-butyl)-phenyl]-[p-terphenyl]-4,4'-diamine; N,N'-bis(4-t-butylphenyl)-N,N'-bis[4-(1-butyl)-phenyl]-[p-terphenyl]-4,4'-diamine; N,N,N',N'-tetra[4-(1-butyl)-phenyl]-[p-terphenyl]-4,4'-diamine; N,N,N',N'-tetra[4-t-butyl-phenyl]-[p-terphenyl]-4,4'-diamine; N,N'-diphenyl-N,N'-bis(4-methylphenyl)-1,1'-biphenyl-4,4'-diamine; N,N'-bis(4-methylphenyl)-N,N'-bis(4-ethylphenyl)-1,1'-(3,3'-dimethylbiphenyl)-4,4'-diamine; 4,4'-bis(diethylamino)-2,2'-dimethyltriphenylmethane; N,N'-diphenyl-N,N'-bis(3-methylphenyl)-[1,1'-biphenyl]-4,4'-diamine; N,N'-diphenyl-N,N'-bis(alkylphenyl)-1,1'-biphenyl-4,4'-diamine; and N,N-diphenyl-N,N'-bis(chlorophenyl)-1,1'-biphenyl-4,4'-diamine. Combinations of different charge compounds are also contemplated so long as they are present in an effective amount. In further embodiments, the charge transport compound is a diamine represented by the molecular structure below:

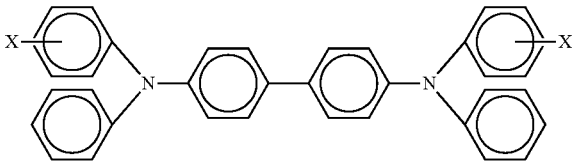

wherein X is selected from the group consisting of alkyl, hydroxy, and halogen. Such diamines are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507; these disclosures are herein incorporated in their entirety for reference.

The charge transport compound may comprise from about 10 to about 90 weight percent of the CTL, based on the total weight of the CTL. In an exemplary embodiment, the charge transport compound comprises from about 35 to about 75 weight percent or from about 60 to about 70 weight percent of the CTL for optimum function. Typically, the CTL has a thickness of from about 10 to about 40 micrometers. It may also have a Young's Modulus in the range of from about $3.0\times10^5$ psi to about $4.5\times10^5$ psi, a thermal contraction coefficient of from about $6\times10^{-5}$/° C. to about $8\times10^{-5}$/° C.

Since the CTL 20 can have a substantially greater thermal contraction coefficient constant compared to that of the flexible support substrate 10, the prepared flexible electrophotographic imaging member will typically exhibit spontaneous upward curling into a 1½ inch roll if unrestrained, after CTL application and through elevated temperature drying then cooling processes, due to the result of larger dimensional contraction in the CTL 20 than the support substrate 10, as the imaging member cools from the glass transition temperature of the CTL down to room ambient temperature of 25° C. after the heating/drying processes of the applied wet CTL coating. Therefore, a substantial internal tensile pulling strain is build-in in the CTL as it contracts more than that in the substrate after cooling down. The internal stress/strain build-in in the CTL can be expressed in equation (1) below:

$$\in=(\alpha_{CTL}-\alpha_{sub})(Tg_{CTL}-25^\circ\text{ C.}) \quad (1)$$

wherein $\in$ is the internal strain build-in in the CTL, $\alpha_{CTL}$ and $\alpha_{sub}$ are coefficient of thermal contraction of CTL and substrate respectively, and $Tg_{CTL}$ is the glass transition temperature of the CTL. Therefore, equation (1), has indicated that the key to suppress or control the imaging member upward curling is by simply decreasing the $Tg_{CTL}$ of the CTL to minimize the internal stress/strain building up and impact flatness.

However, in this conventional imaging member, an ACBC 1 is required to be applied to the back side of the support substrate 10 (which is the side opposite the side bearing the electrically active coating layers) in order to counteract the curl and render the prepared imaging member with desired flatness.

The Anticurl Back Coating

Since the CTL 20 and the ground strip layer 19 are simultaneously applied by solution co-coating process, the applied wet films are dried at elevated temperature and then subsequently cooled down to room ambient. The resulting imaging member web if, at this point, not restrained, will spontaneously curl upwardly into a curl-up roll due to greater dimensional contraction and shrinkage of the CTL/ground strip layer than that of the substrate support layer 10. An ACBC 1, as the conventional multilayered flexible electrophotographic imaging member shown in FIG. 1, is then applied to the back side of the support substrate 10 (which is the side opposite the side bearing the electrically active coating layers) in order to render the prepared imaging member with desired flatness.

Generally, the ACBC 1 comprises a thermoplastic polymer and an adhesion promoter. The thermoplastic polymer, in some embodiments being the same as the polymer binder used in the CTL, is typically a bisphenol A polycarbonate, which along with the addition of an adhesion promoter of polyester are both dissolved in a solvent to form an ACBC solution. The coated ACBC 1 must adhere well to the support substrate 10 to prevent premature layer delamination during imaging member belt machine function in the field.

In a conventional ACBC, an adhesion promoter of copolyester is included in the bisphenol A polycarbonate poly(4,4'-isopropylidene diphenyl carbonate) material matrix to provide adhesion bonding enhancement to the substrate support. Satisfactory adhesion promoter content is from about 0.2 percent to about 20 percent or from about 2 percent to about 10 percent by weight, based on the total weight of the ACBC. The adhesion promoter may be any known in the art, such as for example, VITEL PE2200 which is available from Bostik, Inc. (Middleton, Mass.). The ACBC has a thickness that is adequate to counteract the imaging member upward curling and provide flatness; so, it is of from about 5 micrometers to about 50 micrometers or between about 10 micrometers and about 20 micrometers. A typical, conventional ACBC formulation of the conventional imaging member of FIG. 1 does therefore have a 92:8 ratio of polycarbonate to adhesive.

The Ground Strip Layer

The ground strip layer 19, shown in FIG. 1, is typically applied by solution co-coating technique, simultaneously along with CTL application, and then subjected to the same elevated temperature drying and cooling processes as described in the CTL coating above. The prepared ground strip layer does therefore contain the same internal stress/stress/strain build-up in the layer like that of the CTL 20. The conventional ground strip layer 19 including, for example, conductive particles dispersed in a film forming binder may be applied adjacent to the CTL and at one edge of the imaging member to promote electrical continuity with the conductive ground plane 12 through the hole blocking layer 14. Ground strip layer of prior art is typically comprise of a film forming bisphenol A polycarbonate binder and electrically conductive particles. Typical ground strip materials include those enumerated in U.S. Pat. No. 4,664,995, the entire disclosure of which is incorporated by reference herein.

However, ground strip layer 19 prepared according to the present disclosure embodiment is a re-designed layer of ground strip layer formulation I which comprises a novel film forming A-B diblock copolymer binder, ethyl cellulose, and graphite dispersion. The film forming A-B diblock copolymers selected for use (comprising of a bisphenol A polycarbonate segment block (A) and a phthalic acid containing segment block (B) terminal) are shown in Formulas A and B. These polymers are available from Sabic Innovative Plastics and have a Mw of 115,000.

Formula A

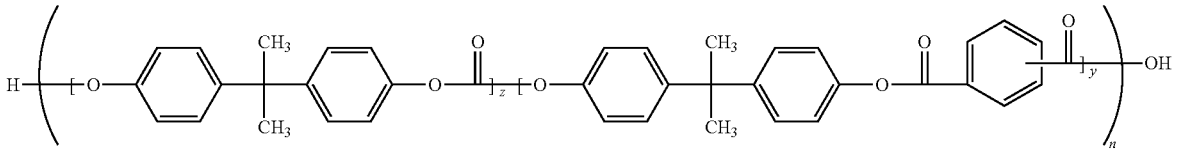

Block (A) Block (B)

Formula B

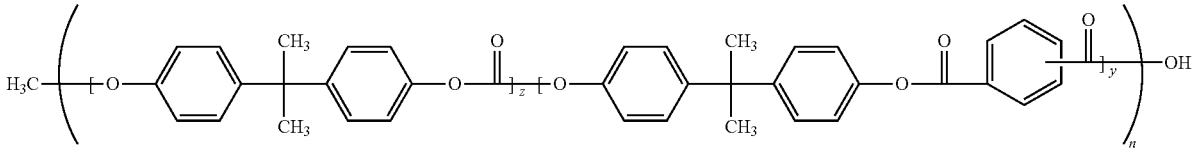

Block (A) Block (B)

In the above Formulas A and B, z represents the number of bisphenol A repeating units of block (A) and is from about 9 to about 18, y is number of repeating phthalic acid in block (B) and is from about 1 to about 2, and n is the degree of polymerization. In embodiments, the degree of polymerization of the diblock copolymer, n, is between about 20 and about 80 and the copolymer has a molecular weight of between about 100,000 and about 200,000.

The novel film forming A-B diblock copolymer, being a polycarbonate, is derived from the bisphenol A polycarbonate structure by the inclusion of small fraction of phthalic acid into the polymer backbone, and the resulting copolymer contains about 90 mole percent of a bisphenol A segment block (A) linearly linking to about 10 mole percent of a segmental block (B) of phthalic acid terminal in the A-B diblock copolymer chain. However, to extend coverage of the present disclosure, the copolymer may further include structural variances of the A-B diblock copolymer of Formulas (I) and (II), through the replacement of the bisphenol A segmental block (A) in the copolymer by each of the following types of carbonates:

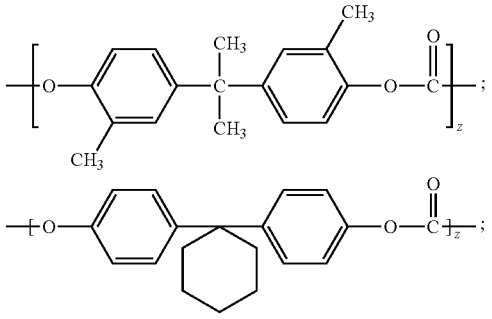

-continued

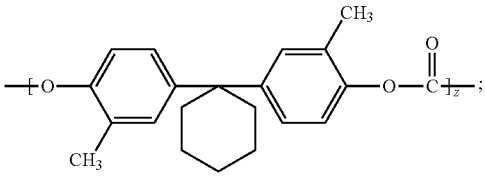

; and

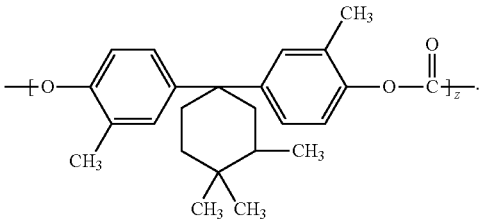

In the further embodiments, as shown in FIG. 2, the phthalic acid terminal block (B) linkage in the A-B diblock copolymer molecule of both Formulas (I) and (II) may also be replaced by one of the following:

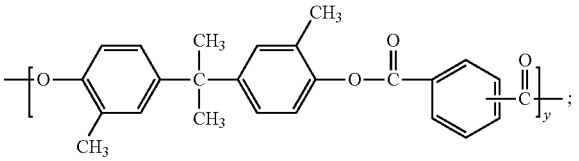

;

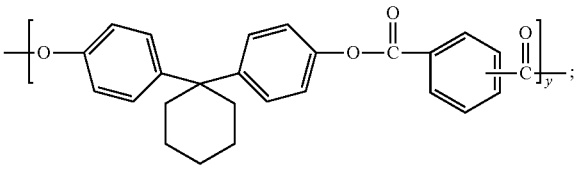

;

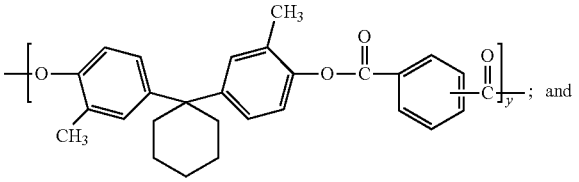

; and

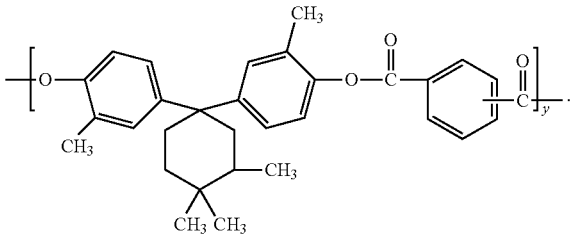

Additionally, the phthalic acid terminal block (B) in the A-B diblock copolymer may be replaced with a terephthalic acid or an isophthalic add represented by the following, respectively:

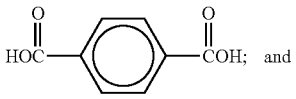

; and

-continued

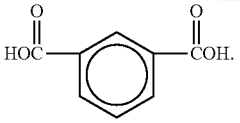

Or alternatively by an adipic acid or an azelaic acid shown below:

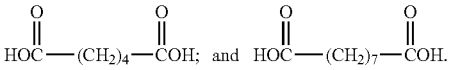

In the ground strip layer formulation I, there may also be included an inorganic or organic particle dispersion to enhance wear resistance. For example, the ground strip layer is comprised of from about 65 to about 85 weight percent of film forming A-B diblock copolymer binder, from about 0.5 to about 3 weight percent ethyl cellulose, from about 15 to about 25 weight percent graphite, and from about 1 to about 5 weight percent silica or PTFE particles dispersion, based on the combined weight of copolymer binder, ethyl cellulose, graphite, and silica or PTFE in the resulting ground strip layer.

Alternatively, variance of ground strip layer formulation I may also be prepared to comprise the film forming A-B diblock copolymer binder and an electrically conductive carbon black particles dispersion, and an inorganic or organic particle dispersion. That is, the ground strip layer may comprise from about 60 to about 80 weight percent film forming A-B diblock copolymer binder, from about 20 to about 40 weight percent carbon black, and from about 1 to about 5 weight percent silica or PTFE particles dispersion, based on the combined weight of copolymer binder, carbon black, and silica or PTFE in the resulting ground strip layer.

Figure 2A:
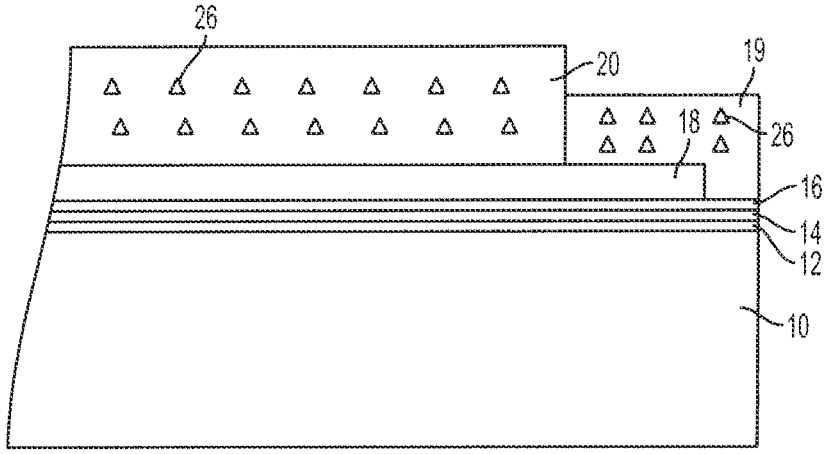
FIG. 2A is a cross-sectional view of a structurally simplified flexible multilayered electrophotographic imaging member, having a stress/strain free single charge transport layer and ground strip layer both plasticized with an organic liquid 26 and without the inclusion of an anticurl back coating, according to an embodiment of the present disclosure.

The embodiment of a structurally simplified flexible multilayered electrophotographic imaging member as derived from the imaging member of FIG. 1 is shown in FIG. 2A. This imaging member exhibits the desired flatness without the application of an ACBC. It is prepared according to the same material compositions described in FIG. 1, except that both the CTL 20 and the co-coated ground strip layer 19 incorporate a plasticizer to render matching stress/strain relief in the two adjacent layers for facilitating imaging member flatness. The substrate 10, conductive ground plane 12, hole blocking layer 14, and adhesive interface layer 16, CGL 18, CTL 20, and ground strip layer 19 of the structurally simplified imaging member are prepared to have the same materials, compositions, thicknesses, and follow the same procedures as those described in the conventional imaging member of FIG. 1 except that the CTL 20 and its co-coated adjacent ground strip layer 19 are both modified by the incorporation of an organic liquid plasticizer 26 to provide each respective layer with stress/strain relief and to render imaging member flatness.

Figure 2B:
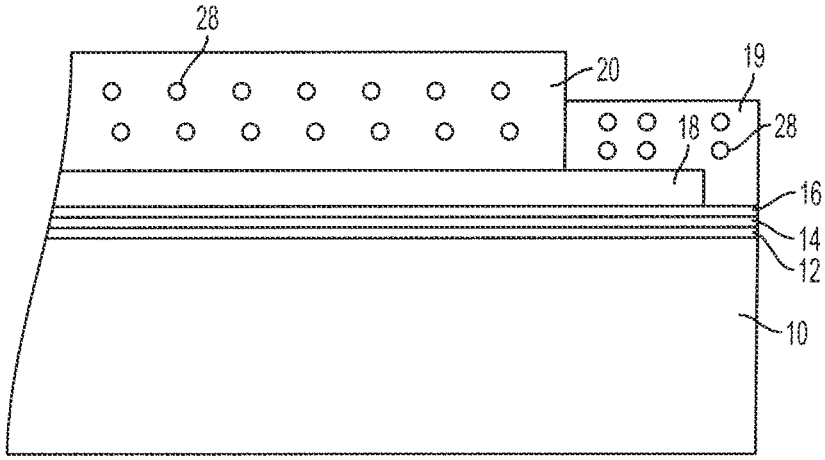
FIG. 2B is a cross-sectional view of a structurally simplified flexible multilayered electrophotographic imaging member, having a stress/strain free single charge transport layer and ground strip layer plasticized with a fluoroketone liquid 28 and without the inclusion of an anticurl back coating, according to an embodiment of the present disclosure.

In further embodiments, as shown in FIG. 2B, the preparation of a structurally simplified flexible multilayered electrophotographic imaging member exhibiting the desired flatness without the ACBC is prepared to comprise the substrate 10, conductive ground plane 12, hole blocking layer 14, and adhesive interface layer 16, CGL 18, CTL 20, and the disclosed ground strip layer 19 formed by following the same steps and material compositions as that described in above FIG. 2A except that the organic liquid plasticizer 26 used for plasticizing the CTL 20 and its adjacent ground strip layer 19 is now replaced with a low surface energy fluoro-containing organic liquid 28. Since fluoro-ketones are low surface energy liquids, the incorporation of such materials provide key plasticization effect to minimize the internal stress/strain build-up in the layers for imaging member curl control as well as render surface energy lowering outcome to provide the resulting CTL and ground strip layer with surface slipperiness for contact friction reduction.

Figure 3:
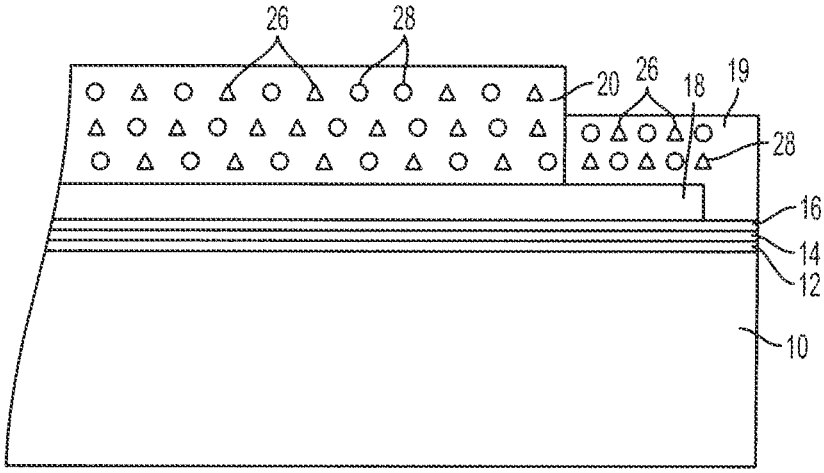
FIG. 3 is a cross-sectional view of yet another structurally simplified flexible multilayered electrophotographic imaging member, having a stress/strain free single charge transport layer and ground strip layer plasticized with a binary mixture liquids 26 and 28 without the inclusion of an anticurl back coating, according to an embodiment of the present disclosure.

In further extended embodiments, referring to FIG. 3, the structurally simplified flexible multilayered electrophotographic imaging member is prepared with a plasticized single CTL 20 and plasticized ground strip layer 19 in accordance with the embodiments of FIGS. 2A and 2B but with the exception that the single component plasticizer, being either an organic liquid plasticizer 26 or a fluoro-containing ketone 28, incorporated in the CTL 20 and ground strip layer has been alternatively replaced with a binary mixture of equal parts of two plasticizers 26 and 28 in every possible mixing combination. In particular, the binary plasticizer mixture is formed by mixing each liquid 26 of Formulas (IA), (IIA), (III), (IV), (V), (VI), (VII), (1), (2), (3), (4), (5), (6), (A), and (B) with a liquid 28 selected from each of the eight fluoroketones. The total amount of the two plasticizer mixture present in the single CM/ground strip layer of the prepared imaging member, shown in FIG. 3, is in a range of from about 3 to about 30 weight percent or between about 5 and about 12 weight percent based on the total weight of each respective resulting layer. The weight ratios of organic liquid 26 to fluoroketone 28 in the plasticizer mixture is from about 10:90 to about 90:10. Therefore, the use of binary plasticizer mixture in the CTL and the ground strip provides the option of being able to adjust or tune the slipperiness of the surface of both layers to meet any specific xerographic machine's need.

Figure 4:
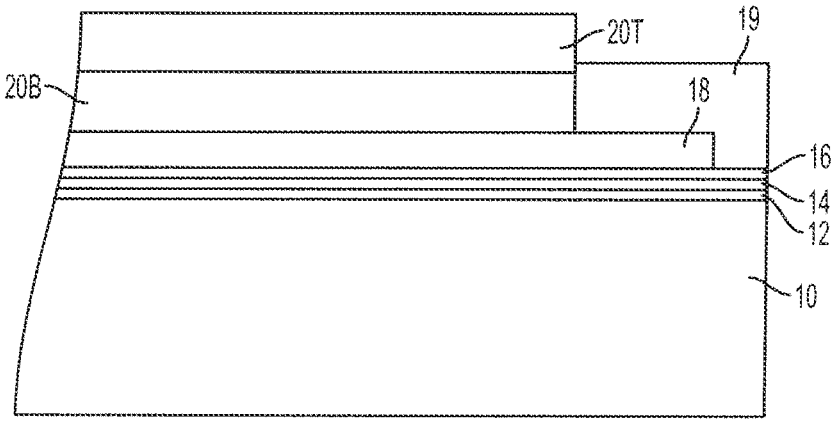
FIG. 4 is a cross-sectional view of a structurally simplified flexible multilayered electrophotographic imaging member having stress/strain free dual charge transport layers and a ground strip layer all incorporated with plasticizer(s) and without the inclusion of an anticurl back coating according to an embodiment of the present disclosure.

In still another embodiment, the structurally simplified flexible multilayered electrophotographic imaging member, shown in FIG. 4, is prepared such that the CTL 20 is redesigned to have dual plasticized layers, consisting of a bottom layer 20B and a top exposed layer 20T. An organic plasticizing liquid 26 is incorporated into these dual layers and the adjacent ground strip layer. Both plasticized dual CTLs are about the same thickness, comprise the same combination of diamine m-TBD and polycarbonate binder. In embodiments, the dual layers are comprised of from about 30 to about 70 weight percent of N,N'-diphenyl-N,N'-bis(3-methylphenyl)-1,1'-biphenyl-4,4'-diamine (mTBD) charge transporting compound, and from about 70 to about 30 weight percent of polycarbonate binder. The amount of organic liquid plasticizer 26 incorporated into each of the dual layers and the ground strip layer is the same, that is, from about 3 to about 30 weight percent or between about 5 and about 12 weight percent with respect to the total weight of each respective layer. In the modification of these same embodiments, the organic liquid 26 plasticized dual CTLs are further re-formulated such that the bottom layer 20B contains greater amount of diamine m-TBD than that in the top exposed layer 20T for preserving the photoelectrical integrity and mechanical function of the imaging member. In such embodiments, the bottom layer 20B comprises from about 40 to about 70 weight percent diamine m-TBD while the top layer 20T comprises from about 20 to about 60 weight percent diamine m-TBD based on the combined weight of diamine m-TBD and polycarbonate binder of the respective layer. In further embodiments, the plasticizing liquid of the imaging member of FIG. 4 is selected from a fluoro-containing organic liquid 28.

In yet other embodiments of the structurally simplified flexible multilayered electrophotographic imaging members of FIG. 4, both dual CTLs and the adjacent ground strip layer of present disclosure are plasticized by using the binary mixture plasticizers of equal parts of 26 and 28. Both of these layers are designed to comprise about the same thickness, the same diamine m-TBD and polycarbonate binder, and the same amount of binary plasticizer liquid mixture incorporation of from about 3 to about 30 weight percent or between about 5 and about 12 weight percent with respect to the total weight of each respective layer. However, in embodiments, the bottom layer 20B may contain larger amounts of diamine m-TBD than that in the top layer 20T, that is, the bottom layer comprises from of about 40 to about 70 weight percent diamine m-TBD while the slippery top outermost layer comprises from about 20 to about 60 weight percent diamine m-TBD to maintain photoelectrical integrity and enhance the mechanical performance.

Figure 5:
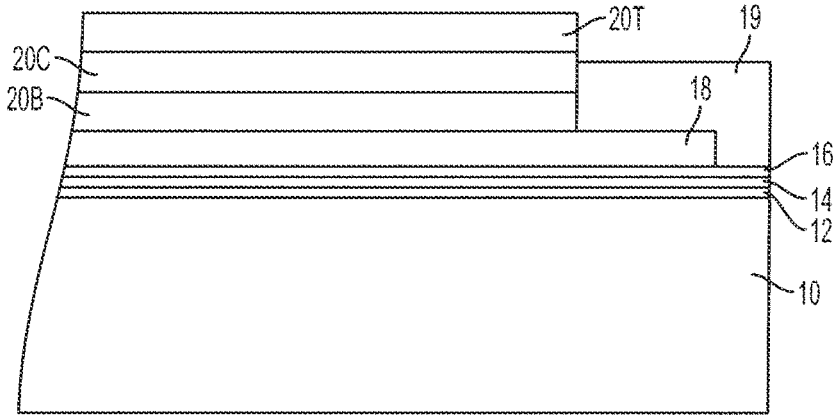
FIG. 5 is a cross-sectional view of a structurally simplified flexible multilayered electrophotographic imaging member, having stress/strain free triple charge transport layers and a ground strip layer all incorporated with plasticizer(s) and without the inclusion of an anticurl back coating, according to an embodiment of the present disclosure.

In the additional embodiments, the plasticized CTL in the structurally simplified flexible multilayered electrophotographic imaging member of this disclosure, as shown in FIG. 5, is another re-design that gives triple CTL layers: a bottom layer 20B, a center layer 20C and a top outermost exposed layer 20T, wherein all of the three CTLs are comprised of about the same thickness, the same diamine m-TBD and polycarbonate binder composition matrix. In these embodiments, the triple CTLs and the adjacent ground strip layer are plasticized with the same amount of organic liquid 26 from about 3 to about 30 weight percent or between about 5 and about 12 weight percent with respect to the total weight of each respective layer. In further embodiments, the plasticizer selected for the triple CTLs incorporation is a fluoroketone 28. In alternative embodiments, the plasticized triple CTLs in the structurally simplified flexible imaging member are reformulated such that all of the structural dimensions and material compositions of the CTLs are maintained identically to what already described, but with the exception that the single component plasticizer present in these triple layers and the adjacent ground strip layer of present disclosure is alternatively replaced with a mixture of equal parts of the two different plasticizers 26 and 28. As described above, the binary plasticizer mixture is formed to give every possible variety of compositions; that is for example, by mixing each liquid 26 of Formulas (IA), (IIA), (III), (IV), (V), (VI), (VII), (1), (2), (3), (4), (5), (6), (A), and (B) with a liquid 28 selected from each of the eight fluoroketones.

In further extended embodiments, the imaging member of FIG. 5 having the triple CTLs (comprising about the same thickness, the same diamine m-TBD and polycarbonate binder composition matrix, the exact same amount of plasticizer addition of from about 3 to about 30 weight percent or between about 5 and about 12 weight percent with respect to the total weight of each respective layer) are modified to comprise different amounts of diamine m-TBD in descending order from bottom to the top layer, such that the bottom layer 20B has from about 50 to about 80 weight percent, the center layer 20C has from about 40 to about 70 weight percent, and the top outermost exposed layer 20T has from about 20 to about 60 weight percent diamine m-TBD to maintain photoelectrical integrity as well as improve the mechanical function.

Figure 6:
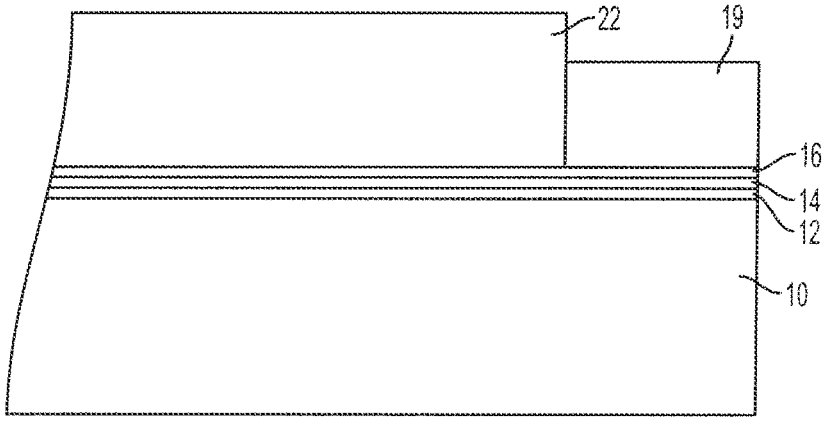
FIG. 6 is a cross-sectional view of a structurally simplified flexible multilayered electrophotographic imaging member, having a stress/strain free single charge generating-transporting layer and a ground strip layer both incorporated with plasticizer(s) and no application of an anticurl back coating, according to an alternative embodiment of the present disclosure.

As an alternative to the two discretely separated imaging layers being a CTL 20 and a CGL 18, as shown in FIGS. 1, 2A, 2B, 3, 4, and 5, a structurally simplified flexible multilayered electrophotographic imaging member may be configured according to FIG. 6. Although all other layers are formed in the same manner and with the same compositions as the preceding figures, a single imaging layer 22 having both charge generating and charge transporting capabilities is instead utilized. The single imaging layer 22 is plasticized along with its adjacent ground strip layer 19 by using the present disclosed plasticizers to reduce the internal stress/strain build-up for curl control without the need for an ACBC. As disclosed in the prior references, for example in U.S. Pat. No. 6,756,169, the single imaging layer 22 may comprise a single electrophotographically active layer capable of retaining an electrostatic charge in the dark during electrostatic charging, imagewise exposure, and image development. Nevertheless, the plasticized single imaging layer 22 may be formed to include charge transport molecules (the same to those of the CTL 20 according to the description in the preceding), may optionally include a photogenerating/photoconductive material similar to those of the CGL 18 described above, and may include a plasticizer. In exemplary embodiments, the single imaging layer 22 along with its adjacent ground strip layer 19 are both plasticized by using a single plasticizer liquid 26 which is selected from one of Formulas (IA), (IIA), (III), (IV), (V), (VI), (VII), (1), (2), (3), (4), (5), (6), (C), and (D) for internal stress/strain relief and curl elimination. The amount of the single component plasticizer incorporation into the layer is from about 3 to about 30 weight percent or between about 5 and about 12 weight percent with respect to the total weight of the single layer 22 and the ground strip layer 19.

In another exemplary embodiment, shown in FIG. 6, the single imaging layer 22 and the ground strip layer 19 are both plasticized with a fluorketone liquid 28 selected from each of the eight listed fluoroketones to render the surface slipperiness effect.

In yet another exemplary embodiment, the plasticized single imaging layer 22 and the ground strip layer 19 are plasticized with a plasticizer mixture consisting of equal parts of the two different plasticizer categories. The binary plasticizer mixture is formed to give every possible variety of compositions, for example, by mixing each liquid 26 of Formulas (IA), (IIA), (III), (IV), (V), (VI), (VII), (1), (2), (3), (4), (5), (6), (A), and (B) with a liquid 28 selected from each of the eight fluoroketones. The weight ratios of organic liquid 26 to fluoroketone 28 in the plasticizer mixture is from about 10:90 to about 90:10. The amount of the binary plasticizers mixture incorporated into each layer is from about 3 to about 30 weight percent or between about 5 and about 12 weight percent with respect to the total weight of the resulting single layer 22 and the resulting ground strip layer 19.

It is important to emphasize that the selection of organic phthalates, monomeric carbonates, and fluoro-containing organic liquids, for use as a single plasticizer or a binary mixture of plasticizers to be incorporated into the CTL and ground strip layer of all the preceding prepared flexible imaging members to meet plasticization and curl control requirement, is based on the fact that these plasticizers are (a) each a high boiling compound with boiling point of at least 250° C. so their presence in the CTL(s) and ground strip layer does effect a permanent plasticizing result and (b) each are totally miscible/compatible with the compositions of the CTL(s) and the ground strip layer in a manner such that the incorporation into the respective CTL/ground strip layer material matrix does not cause deleterious degradation to the photoelectrical function of the resulting imaging member. Furthermore, both the CTL(s) and the ground strip layer of this disclosure are incorporated with the same amount of plasticizer of from about 3 to about 30 weight percent or between about 5 and about 12 weight percent, based on the total weight of each respective layer.

In general, the thickness of the plasticized CTL(s) (being a plasticized single layer, dual layers, or triple layers) in all the disclosed embodiments is (are) prepared according to FIGS. 2 to 6 disclosed above, and is in the range of from about 10 to about 100 micrometers, or between about 15 and about 50 micrometers. The top outermost layer of these imaging members employ compounded CTLs formulated to comprise the least amount of diamine m-TBD charge transport molecules (in the descending concentration gradient from the bottom layer up to the top exposed layer) to: (1) inhibit diamine m-TBD crystallization at the interface between two coating layers, (2) to enhance the top layer's fatigue cracking resistance during dynamic machine belt cyclic function in the field, and (3) to maintain good photoelectrical properties to assure the resulting anticurl back coating-free imaging member belts properly function in the field.

The structurally simplified flexible multilayered electrophotographic imaging member of the present disclosure, prepared to contain plasticized CTL(s) and a adjacent plasticized ground strip layer to one edge of the imaging member without the application of an ACBC, preserves the photoelectrical integrity and ground strip layer electrical conductivity with respect to each control imaging member counterpart. In particular, that means having charge acceptance ($V_0$) in a range of from about 750 to about 850 volts; sensitivity (S) sensitivity from about 250 to about 450 volts/ergs/cm$^2$; residual potential ($V_r$) less than about 50 volts; dark development potential (Vddp) of between about 280 and about 620 volts; and dark decay voltage (Vdd) of between about 50 and about 20 volts, and a ground strip layer resistivity (reversal of conductivity) less than 35,000 ohms/sq (Ω/sq).

For typical conventional ionographic imaging members used in an electrographic system, an electrically insulating dielectric imaging layer is applied to the electrically conductive surface. The substrate also contains an ACBC on the side opposite from the side bearing the electrically active layer to maintain imaging member flatness. In the present embodiments, the structurally simplified flexible ionographic imaging member of this disclosure may also conveniently be prepared without the need for an ACBC, through incorporating the dielectric imaging layer and the ground strip layer with the use of plasticizer(s) incorporation according to the same manner and descriptions demonstrated in the structurally simplified flexible electrophotographic imaging members as described above.

In summary, the disclosed ground strip layer formulations I and II of each embodiment described in the preceding embodiments, have a thickness ranging from about 7 micrometers to about 42 micrometers, or from about 14 micrometers to about 23 micrometers. To further improve the mechanical performance of these ground strip layer formulations, the layers may also include an additive of inorganic or organic fillers to impart and/or enhance greater wear resistance. Inorganic fillers may include, but are not limited to, silica, metal oxides, metal carbonate, metal silicates, and the like, and mixtures thereof. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nano-sized inorganic or organic particles can be used in the fillers to achieve mechanical property reinforcement.

A prepared flexible multilayered electrophotographic imaging member belt, comprising a ground strip layer formulated according to the present disclosure, from any of the above embodiments, may thus thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

All the exemplary embodiments encompassed herein include a method of imaging which includes generating an electrostatic latent image on a slippery surface and curl-free flexible imaging member, developing a latent image, and transferring the developed electrostatic image to a suitable receiving substrate.

The development of the presently disclosed embodiments will further be demonstrated in the non-limiting Working Examples below. They are, therefore in all respects, to be considered as illustrative and not restrictive nor limited to the materials, conditions, process parameters, and the like recited herein. The scope of embodiments are being indicated by the appended claims rather than the foregoing description. All changes that come within the meaning of and range of equivalency of the claims are intended to be embraced therein. All proportions are by weight unless otherwise indicated. It will be apparent, however, that the present embodiments can be practiced with many types of compositions and can have many different uses in accordance with the disclosure above and as pointed out hereinafter.

EXAMPLES

Example 1

Control Ground Strip Layers

Control Ground Strip Layer I

Twenty two 9 inch×11 inch rectangular sheets of 4.2-mil thick biaxially oriented polyethylene naphthalate (PEN, available as KADALEX from DuPont Teijin Films), having a 0.02 micrometer thick titanium surface layer, were each coated onto with a 0.04 micrometer thick dried/cured gamma aminopropyltriethoxy silane coating and subsequently applied over to give 0.02 micrometer ARDEL polyarylate adhesive interface layer. These cut pieces of PEN substrates (having these coatings) were used as the substrate supports for demonstration ground strip layer samples prepared in each of the following working examples.

A conventional ground strip layer coating solution was prepared by combing 10.5 grams of bisphenol A polycarbonate binder (FPC 0170, having a molecular weight of about 120,000 and commercially available from Mitsubishi Chemicals), 1.20 grams ethyl cellulose, 3.92 grams graphite dispersion, and 0.45 gram silica particles in 183 grams methylene chloride solvent. The coating solution was then applied over one of the above mentioned 4.2-mil PEN substrate support, by following the standard hand coating procedures and dried at 130° C. in an air circulating oven for 2 minutes, to give a 18 micrometers dry thickness first group strip layer control sample. If unrestrained, the prepared ground strip layer sample will spontaneously curl upwardly into a 1¾ inch roll.

Control Ground Strip Layer II

Another conventional ground strip layer coating solution was prepared by combing 30.56 grams of bisphenol A polycarbonate binder (FPC 0170), 12 grams XEDAG/KB carbon black, and 1.4 gram silica particles in 416 grams methylene chloride solvent. The coating solution was then applied over second 4.2-mil PEN substrate support, by following the standard hand coating procedures and dried at 130° C. in an air circulating oven for 2 minutes, to give a 18 micrometers dry thickness second group strip layer control sample. If unrestrained, the prepared ground strip layer sample will spontaneously curl upwardly into a 1¾ inch roll.

Example 2

Disclosure Ground Strip Layer Examples

Ground Strip Layer Formulation I

Two ground strip layer variances (Formulation IA and Formulation IB) according to the present embodiments were prepared by following the same procedures and using the same material compositions as those described in each of Control Ground Strip Layers I and II, but with the exception that the bisphenol A polycarbonate binder (FPC 0170, having a molecular weight of about 120,000 and commercially available from Mitsubishi Chemicals) was replaced with a novel film forming A-B diblock copolymer. The novel A-B diblock copolymer, selected for ground strip layer binder use, comprises a bisphenol A polycarbonate segment block (A) and a phthalic acid containing segment block (B) terminal and has a Mw of 115,000. The molecular structures of the polymers are shown in Formulas A and B below:

Formula A

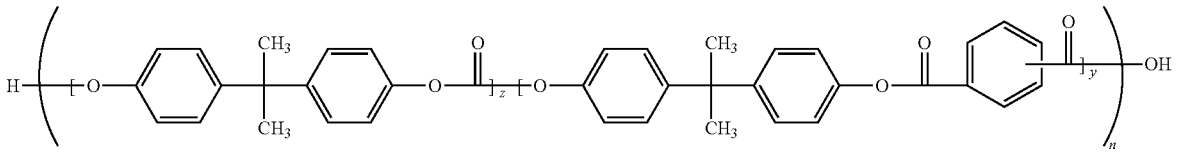

Block (A) Block (B)

-continued

Formula B

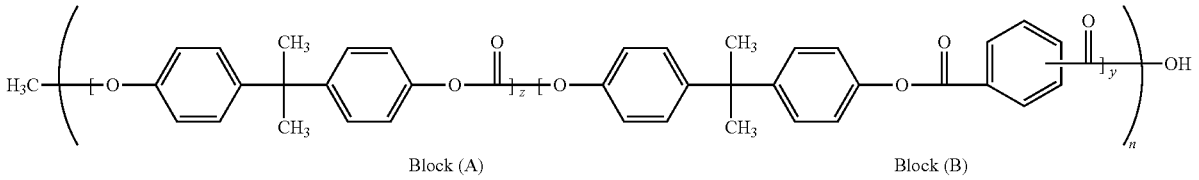

In the above Formulas A and B, z represents the number of bisphenol A repeating units of block (A) and is from about 9 to about 18, y is number of repeating phthalic acid in block (B) and is from about 1 to about 2, and n is the degree of polymerization. In embodiments, the degree of polymerization of the diblock copolymer, n, is between about 20 and about 80 and the copolymer has a weigh average molecular weight of between about 100,000 and about 200,000.

The resulting ground strip Formulation IA comprises A-B diblock copolymer binder, ethyl cellulose, graphite particles, and silica particles dispersion, whereas the ground strip Formulation IB comprises A-B diblock copolymer binder, XEDAG/KB carbon black, and silica particles dispersion.

If unrestrained, both prepared ground strip layer variances of present disclosure, about 18 micrometers dry thickness as obtained after drying, did spontaneously curl upwardly into a 1¾ inch roll equivalent to that seen in the ground strip layers of Control Examples I and II.

Ground Strip Layer Formulation II

Six other ground strip layers were prepared with the same procedures and using the same material compositions as those described in the two ground strip layer variances of the preceding section Example Ground Strip Layer Formulation I, except that 5, 10, and 15 weight percent of liquid diethyl phthalate (DEP) plasticizer, based on the combined weight of DEP and copolymer in the layer, were incorporated into the two ground strip layer composition variances to relieve/eliminate the internal stress/strain build-up in each sample layer for effective curl control/suppression. The molecular structure of DEP, available from Sigma-Aldrich Corporation (St. Louis, Mo.), is shown in Formula (II) below:

Formula (II)

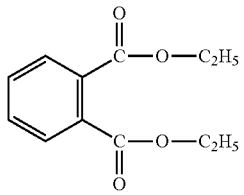

The six resulting plasticized ground strip layers, about 18 micrometers dried thickness each, exhibited little or no upward curling.

Ground Strip Layer Formulation III

Additionally, six more plasticized ground strip layers were prepared by following the same procedures and using the same material compositions as those described above, but with the exception that DEP were substituted by 5, 10, and 15 weight percent liquid diethylene glycol bis(allyl carbonate) plasticizer into each respective ground strip layer composition to achieve elimination of internal stress/strain build-up in each layer for effective curl control/suppression. The molecular structure of diethylene glycol bis(allyl carbonate), CR-39, available from PPG Industries, Inc. (Pittsburgh, Pa.), is shown in Formula (6) below:

Formula (6)

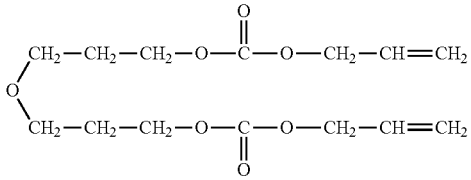

Ground Strip Layer Formulation IV

In an extended example, six other plasticized ground strip layers samples were prepared by following the same procedures and using the same material compositions as detailed in the DEP example, except that the plasticizer used was 5, 10, and 15 weight percent of a monomeric bisphenol A carbonate liquid incorporation into each respective ground strip layer composition to relieve the internal stress/strain build-up in each layer and effect curl control/suppression. The molecular structure of the bisphenol A carbonate liquid (HIRI), available from PPG Industries, Inc., is shown in Formula (1) below:

Formula (1)

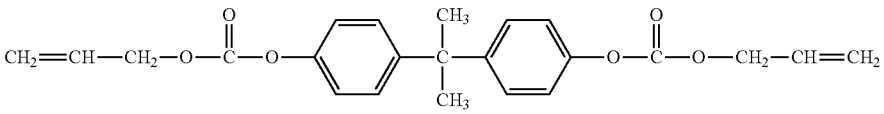

In summary, all of the resulting plasticized ground strip layers, about 18 micrometers dried thickness each, as described in the preceding, exhibited little or no upward curling.

Test Results

Curl and Electrical Conductivity Assessments

Curling-up and electrical resistivity (reciprocal to conductivity) integrity were tested for the Control Ground Strip Layers and the Disclosure Ground Strip Layers I-IV. The results are shown in Table 1 below. As shown, all of the plasticized ground strip layers (prepared using various plasticizers and according to the material and methodology of the present disclosure) have, by comparison to each respective control counterpart, provided effective curl control outcome to render flatness without deleteriously impacting the crucial electrical conductivity of the layer.

TABLE 1

| Ground Strip Layer ID | Curl Diameter (inches) | Resistivity (Ω/sq.)** |
|---|---|---|
| CONTROL I | 1.75 | 6,500 |
| Formulation IA | 1.75 | 6,500 |
| Formulation IA plus 5%/10%/15% DEP | 22/flat/flat | 6,500/6,600/6,800 |
| Formulation IA plus 5%/10%/15% CR39 | 21/flat/flat | 6,500/6,700/6,800 |
| Formulation IA plus 5%/10%/15% HIRI | 20/flat/flat | 6,450/6,700/6,800 |
| CONTROL II | 1.75 | 2,650 |
| Formulation IB | 1.75 | 2,650 |
| Formulation IB plus 5%/10%/15% DEP | 22/flat/flat | 6,450/6,600/6,850 |
| Formulation IB plus 5%/10%/15% CR39 | 21/flat/flat | 6,500/6,600/6,800 |
| Formulation IB plus 5%/10%/15% HIRI | 20/flat/flat | 6,400/6,500/6,750 |

**Note:
the ground strip layer resistivity spec. is 35,000 Ω/sq.

Example 3

Control Imaging Member Preparation

A conventional flexible multilayered electrophotographic imaging member web was prepared by providing a 0.02 micrometer thick titanium layer coated substrate of a biaxially oriented polyethylene naphthalate (PEN, available as KADALEX from DuPont Teijin Films) having a thickness of 4.2 mils. The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer had an average dry thickness of 0.04 micrometer as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry or 1 minute at 125° C. in a forced air oven. The resulting adhesive interface layer had a dry thickness of about 0.02 micrometer.

The adhesive interface layer was thereafter coated over with a CGL. The charge generating layer dispersion was prepared by adding 0.45 gram of IUPILON 200, a polycarbonate of poly(4,4'-diphenyl)-1,1'-cyclohexane carbonate (PCZ 200, available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This CGL comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web was simultaneously coated over with a charge transport layer (CTL) and an adjacent ground strip layer at the edge of the imaging member web by co-extrusion of the two coating solutions. The CTL was prepared by introducing into an amber glass bottle in a weight ratio of 1:1 (or 50 weight percent of each) of a bisphenol A polycarbonate thermoplastic (FPC 0170, having a molecular weight of about 120,000 and commercially available from Mitsubishi Chemicals) and a charge transport compound of N,N'-diphenyl-N,N'-bis(3-methylphenyl)-1,1'-biphenyl-4,4'-diamine.

The resulting mixture was dissolved to give 15 percent by weight solid in methylene chloride. This solution was applied on the CGL by extrusion to form a coating which after drying in a forced air oven gave a dry CTL 29 micrometers thick comprising 50:50 weight ratio of diamine transport charge transport compound to FPC0170 bisphenol A polycarbonate binder. The imaging member web, at this point if unrestrained, would curl upwardly into a 1¾-inch tube.

The strip, about 10 millimeters wide, of the adhesive layer left uncoated by the charge generator layer, was coated with a ground strip layer during the co-extrusion process. The ground strip layer coating solution was prepared by combing 30.56 grams of bisphenol A polycarbonate binder (FPC 0170), 12 grams XEDAG/KB carbon black, and 1.4 gram silica particles in 416 grams methylene chloride solvent in a carboy container. The resulting solution was mixed for 15-30 minutes with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer having a dried thickness of about 19 micrometers.

The imaging member web containing all of the above layers was then passed through 125° C. a forced air oven to dry the co-extrusion coated ground strip and CTL simultaneously to give respective 19 micrometers and 29 micrometers in dried thicknesses. At this point, the imaging member, having all the dried coating layers, would spontaneously curl upwardly into a 1¾-inch roll when unrestrained as the web was cooled down to room ambient of 25° C. Since the CTL, having a glass transition temperature (Tg) of 85° C. and a coefficient of thermal contraction of about $6.6\times10^{-5}$/° C., it had about 3.7 times greater dimensional contraction than that of the PEN substrate having lesser a thermal contraction of about $1.9\times10^{-5}$/° C. Therefore, according to equation (1), a 2.75% internal strain was built-up in the 29 micrometer thick CTL to result in imaging member web upward curling; so, at this point if unrestrained, it would curl upwardly into a 1½-inch tube.

For effecting imaging member web curl control, an ACBC was prepared by combining 88.2 grams of FPC0170 bisphenol A polycarbonate resin, 7.12 grams VITEL PE-200 copolyester adhesion promoter (available from Bostik, Inc., Wauwatosa, Wis.), 9.7 grams of PTFE particles, and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The ACBC solution was then applied to the rear surface (side opposite the charge generating layer and CTL) of the electrophotographic imaging member web by extrusion coating and dried to a maximum temperature of 125° C. in a forced air oven for 3 minutes to produce a dried ACBC having a thickness of 18 micrometers and flattening the imaging member. The flexible imaging member thus obtained was to serve as a control.

Disclosure Imaging Member I Preparation

A full structure flexible multilayered electrophotographic imaging member web of present disclosure was prepared by the following same procedures and with the same material compositions as those described in the Control Imaging Member Preparation, but with the exception that the ground strip layer was re-formulated to comprise the ground strip layer formulation II of the present embodiments. The prepared imaging member, like the imaging member control, included an ACBC to render flatness Disclosure Imaging Member II Preparation A structurally simplified flexible multilayered electrophotographic imaging member web of the present disclosure was subsequently prepared by the same manners and with the same material compositions as those described in the preparation of Disclosure Imaging Member I above, but with the exception that 8.5 weight percent of DEP plasticizer was incorporated into the material matrix of the CTL and the co-coated ground strip layer of present disclosure (based on the combined weight of DEP and copolymer in each layer) at one edge of the imaging member web to respectively eliminate the internal stress/strain from these layers for curl control which thereby eliminated the need for an ACBC. The prepared imaging member had a 8.5 weight percent plasticized CTL/ground strip layer, and exhibited absolute flatness (in both web and cross-web directions) without application of an ACBC.

Test Results

Dynamic Imaging Member Belt Machine Cycling Test

The flexible multilayered electrophotographic imaging member webs obtained according to the embodiments of the Imaging Member Control and those of Disclosure Imaging Members I and II as described above were cut into rectangular sheets of pre-determined dimensions. A pair of opposite ends of each imaging member cut sheet was then brought to overlap together thereof and joined by ultrasonic welding technique into each respective flexible seamed belt.

Both the Control Imaging Member belt and the Disclosure Imaging Member belts were dynamically cycling tested in separate and identical electrophotographic imaging machines. The result as observed indicated that all of the belts exhibited reasonably good cycling quality without notable motion disturbance as each dynamically tracked the edge guide of the belt support module. In particular, the Disclosure Imaging Member belt, comprising plasticized CTL and plasticized ground strip layer, exhibited prevalent flatness in both the belt and the trans-belt directions and gave excellent machine belt cyclic motion quality without edge guide tracking issue. The improved belt motion quality had the added benefit of toner image formation/enhancement on the imaging member belt surface to impact image quality in print out copies.

Thus, in view of the foregoing, the present novel ground strip layer formulations comprising a film forming A-B diblock copolymer binder (both with and without the inclusion of a plasticizer in its material matrix) used in flexible multilayered imaging member belts were shown to be easily adaptable for imaging member production implementation without negatively affecting the photo-electrical function of the resulting imaging member. The incorporation of a plasticizer in both the CTL and ground strip layer was also shown to provide curl control and elimination of ACBC, an effective imaging member manufacture cost-cutting measure.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents as would fall within the true scope and spirit of embodiments herein.

What is claimed is:

1. A flexible imaging member comprising:

a flexible substrate;

a charge generating layer disposed on a first side of the substrate;

at least one charge transport layer disposed on the charge generating layer; and an electrically conductive ground strip layer disposed adjacent to the charge transport layer and at an edge of the imaging member, wherein the ground strip layer comprises a film forming polycarbonate binder being a A-B diblock copolymer binder having a formula selected from the group consisting of Formula A

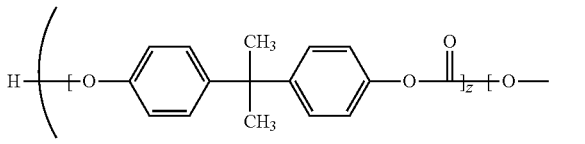

Block (A)

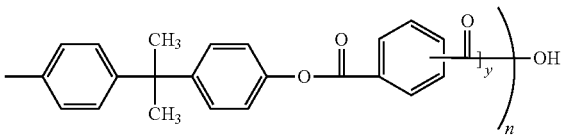

Block (B)

-continued

Formula B

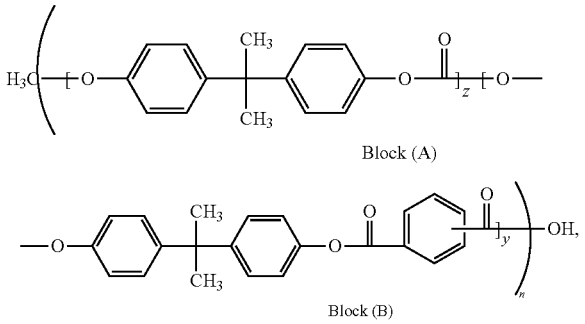

and mixtures thereof, wherein z represents the number of bisphenol A repeating units of block (A) and is from about 9 to about 18, y is number of repeating phthalic acid in block (B) and is from about 1 to about 2, and n is the degree of polymerization and is between about 20 and about 80, an electrically conductive particle dispersion, and an optional additive comprising organic or inorganic particle dispersion.

2. The flexible imaging member of claim 1, wherein the electrically conductive particle dispersion is selected from the group consisting of carbon black, graphite, and mixtures thereof.

3. The flexible imaging member of claim 2, wherein the electrically conductive particle dispersion is graphite and the ground strip layer further includes an ethyl cellulose.

4. The flexible imaging member of claim 1 further including an anticurl back coating positioned on a second side of the substrate opposite to the charge generating layer and the at least one charge transport layer.

7. The flexible imaging member of claim 1, wherein the at least one charge transport layer comprises a charge transport compound and a plasticizing liquid compound having a high boiling point.

8. The flexible imaging member of claim 7, wherein the plasticizing liquid compound in the at least one charge transport layer is selected from the group consisting of liquid phthalates, liquid monomeric carbonates, oligomeric polystyrenes and fluoroketones.

9. The flexible imaging member of claim 7 being free of imaging member upward curling.

10. The flexible imaging member of claim 7, wherein the ground strip layer comprises a plasticizing compound having a high boiling point.

11. The flexible imaging member of claim 10, wherein the plasticizing liquid compound in the ground strip layer is selected from the group consisting of liquid phthalates, liquid monomeric carbonates, oligomeric polystyrenes and fluoroketones.

12. The flexible imaging member of claim 10, wherein the ground strip layer and the at least one charge transport layer contain of from about 3 to about 30 weight percent plasticizer, based on the total weight of each respective layer.

13. The flexible imaging member of claim 10 having web and cross-web flatness.

14. A flexible imaging member comprising:

a flexible substrate;

a charge generating layer disposed on a first side of the substrate;

at least one charge transport layer disposed on the charge generating layer, wherein the charge transport layer comprises a charge transport compound and a plasticizing liquid compound having a high boiling point; and a ground strip layer disposed adjacent to the charge transport layer and at an edge of the imaging member, wherein the ground strip layer comprises a film forming polycarbonate binder being a A-B diblock copolymer binder having a formula selected from the group consisting of Formula A

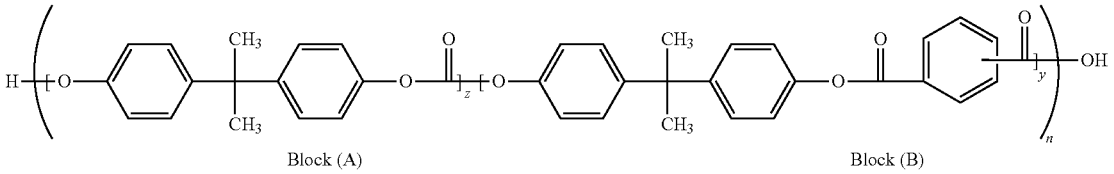

Formula B

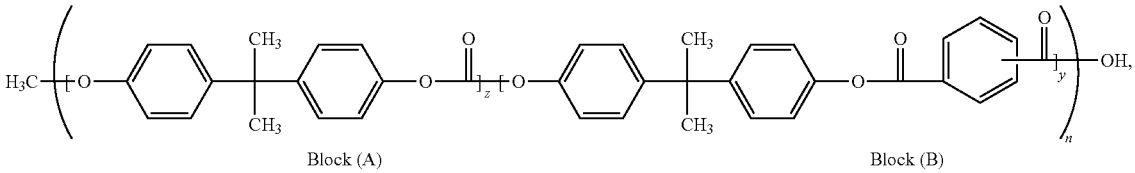

5. The flexible imaging member of claim 1, wherein the additive organic or inorganic particle dispersion in the ground strip layer is selected from the group consisting of a silica particle dispersion, polytetrafluoro ethylene (PTFE) particle dispersion, and mixtures thereof.

6. The flexible imaging member of claim 5, wherein the additive is present in an amount of from about 1 to about 5 percent by weight, based on the combined weight of solid components presents in the ground strip layer.

and mixtures thereof, wherein z represents the number of bisphenol A repeating units of block (A) and is from about 9 to about 18, y is number of repeating phthalic acid in block (B) and is from about 1 to about 2, and n is the degree of polymerization and is between about 20 and about 80, the high boiling plasticizing liquid compound, an electrically conductive particle dispersion, and an optional additive comprising organic or inorganic particle dispersion.

15. The flexible imaging member of claim 14, wherein liquid plasticizing compound is present in the charge transport layer and the ground strip layer in an amount of from about 3 to about 30 percent by weight of the total weight of the respective layer.

16. The flexible imaging member of claim 14, wherein the plasticizing liquid compound is selected from the group consisting of liquid phthalates, liquid monomeric carbonates, oligomeric polystyrenes and fluoroketones.

17. The flexible imaging member of claim 16, wherein the liquid phthalates are selected from the group consisting of Formula (I)

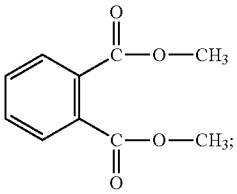

Formula (IA)

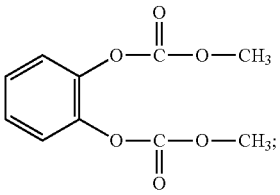

Formula (II)

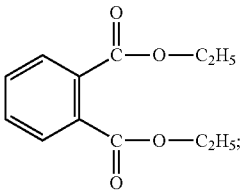

Formula (IIA)

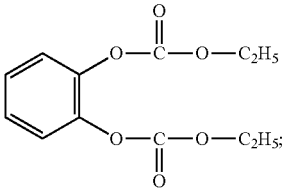

-continued

Formula (III)

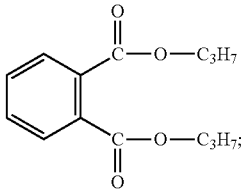

Formula (IV)

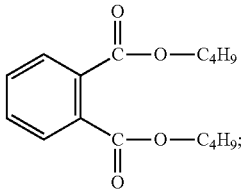

Formula (V)

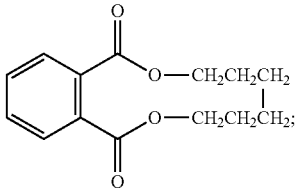

Formula (VI)

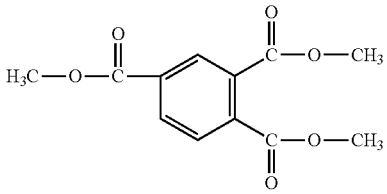

and

Formula (VII)

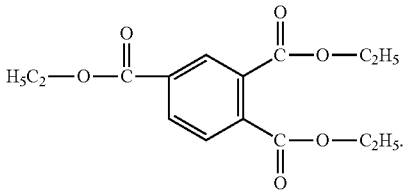

18. The flexible imaging member of claim 16, wherein the liquid monomeric carbonates are selected from the group consisting of Formula (1)

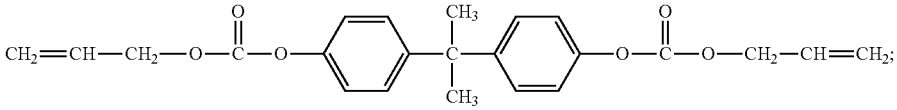

Formula (2)

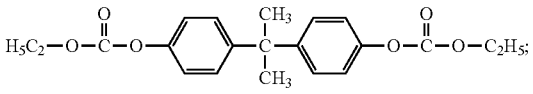

Formula (3)

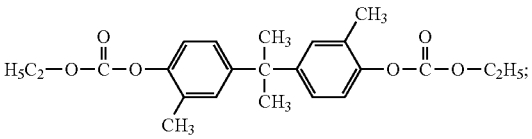

-continued

Formula (4)

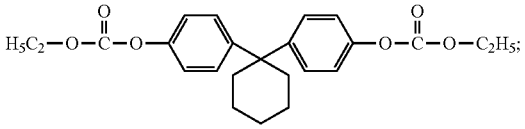

Formula (5)

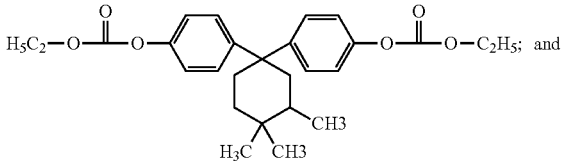

Formula (6)

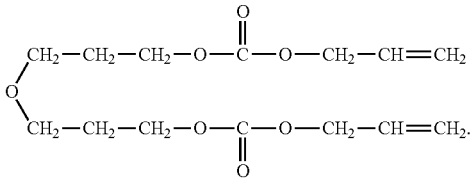

19. The flexible imaging member of claim 16, wherein the oligomeric polystyrenes are selected from the group consisting of Formula (C)

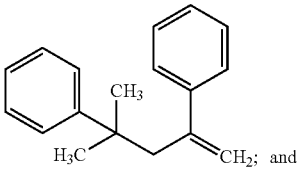

Formula (D)

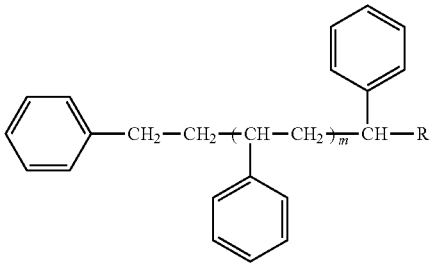

wherein R is selected from the group consisting of H, $CH_3$, $CH_2CH_3$, and $CH{=}CH_2$, and where m is between 0 and 3.

20. The flexible imaging member of claim 16, wherein the fluoroketones are selected from the group consisting of 3-(trifluoromethyl)phenylacetone, 2'-(trifluoromethyl)propiophenone, 2,2,2-trifluoro-2',4'-dimethoxyacetophenone, 3',5'-bis(trifluoromethyl)acetophenone, 3'-(trifluoromethyl)propiophenone, 4'-(trifluoromethyl)propiophenone, 4,4,4-trifluoro-1-phenyl-1,3-butanedione, and 4,4-difluoro-1-phenyl-1,3-butanedione.

21. The flexible imaging member of claim 16, wherein the plasticizing liquid compound comprises a mixture of a fluoroketone and a compound selected from the group consisting of liquid phthalates, liquid monomeric carbonates, and oligomeric polystyrenes.

22. A flexible imaging member comprising:

a flexible substrate;

a charge generating layer disposed on a first side of the substrate;

multiple charge transport layers disposed on the charge generating layer, wherein each of the multiple charge transport layers comprise a charge transport compound and plasticizing liquid compound having a high boiling point; and a ground strip layer disposed adjacent to the multiple charge transport layers and at an edge of the imaging member, wherein the ground strip layer comprises a film forming polycarbonate binder being a A-B diblock copolymer binder having a formula selected from the group consisting of Formula A

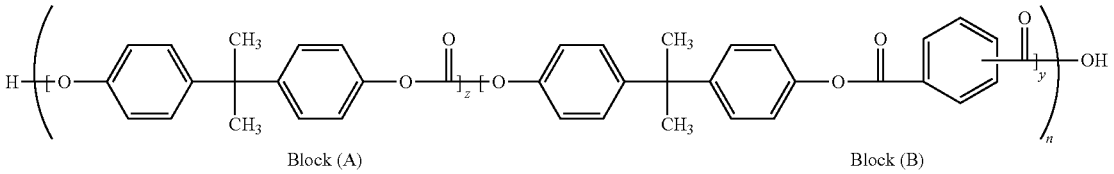

Formula B

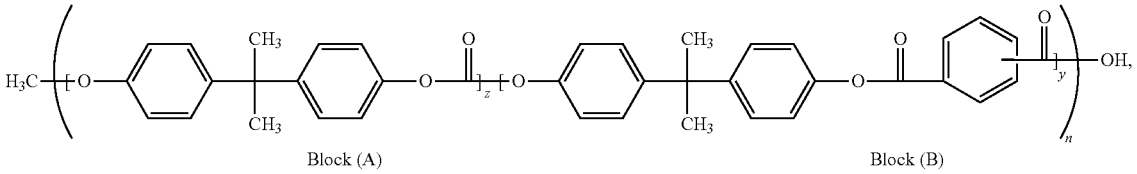

and mixtures thereof, wherein z represents the number of bisphenol A repeating units of block (A) and is from about 9 to about 18, y is number of repeating phthalic acid in block (B) and is from about 1 to about 2, and n is the degree of polymerization and is between about 20 and about 80, a plasticizing liquid having a high boiling point, a carbon black or graphite dispersion, and an optional additive comprising organic or inorganic particle dispersion.

23. The flexible imaging member of claim 22, wherein the multiple charge transport layers comprise a top charge transport layer and a bottom charge transport layer, wherein each of the multiple charge transport layers comprise an amount of charge transport compound and the amount in each layer decreases from the bottom charge transport layer to the top charge transport layer, and wherein the amount in each layer is a percent of charge transport compound per total weight of each respective layer.

24. The flexible imaging member of claim 23, wherein the charge transport compound is present in an amount of from about 50 to about 80 percent in the bottom charge transport layer, from about 40 to about 70 percent in a center charge transport layer, and from about 20 to about 60 weight percent in the top charge transport layer.

* * * * *